US012480384B2

(12) United States Patent
Mansir et al.

(10) Patent No.: US 12,480,384 B2
(45) Date of Patent: Nov. 25, 2025

(54) ENERGY HARVESTING DEVICE FOR DOWNHOLE APPLICATION

(71) Applicant: Halliburton Energy Services, Inc., Houston, TX (US)

(72) Inventors: Hassan Mansir, Frimley (GB); Robert Charles De Long, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/657,203

(22) Filed: May 7, 2024

(65) Prior Publication Data

US 2025/0347198 A1 Nov. 13, 2025

(51) Int. Cl.
*E21B 41/00* (2006.01)

(52) U.S. Cl.
CPC ..... *E21B 41/0085* (2013.01)

(58) Field of Classification Search
CPC ..... E21B 41/0085; E21B 43/128
See application file for complete search history.

(56) References Cited

U.S. PATENT DOCUMENTS

| | | | | |
|---|---|---|---|---|
| 2,940,039 | A * | 6/1960 | Yost | E21B 47/13 310/156.31 |
| 7,906,861 | B2 | 3/2011 | Guerrero et al. | |
| 10,320,311 | B2 | 6/2019 | Gooneratne et al. | |
| 11,328,584 | B2 | 5/2022 | Dinkins et al. | |
| 11,360,121 | B2 | 6/2022 | Sridharan et al. | |
| 2010/0194117 | A1 | 8/2010 | Pabon et al. | |
| 2015/0114632 | A1* | 4/2015 | Romer | E21B 43/168 166/305.1 |
| 2015/0214746 | A1 | 7/2015 | Lopez Gomez et al. | |
| 2017/0362953 | A1* | 12/2017 | Gatzen | E21B 41/0085 |
| 2019/0044381 | A1 | 2/2019 | Valtysson | |
| 2021/0032960 | A1* | 2/2021 | Breerwood | E21B 47/12 |
| 2023/0287787 | A1* | 9/2023 | Fripp | E21B 47/13 |
| 2023/0350440 | A1 | 11/2023 | Desmarais et al. | |

FOREIGN PATENT DOCUMENTS

| | | |
|---|---|---|
| CN | 117421911 | 1/2024 |
| KR | 102132903 | 7/2020 |
| WO | 2018225876 | 12/2018 |
| WO | 2023056019 | 4/2023 |

OTHER PUBLICATIONS

Zheng, et al., "Design and Analysis of a While-Drilling Energy-Harvesting Device Based on Piezoelectric Effect", Energies 2021, 14, 1266. https://doi.org/10.3390/en14051266, Feb. 3, 2021, 15 pages.

"PCT Application No. PCT/US2024/028447 International Search Report and Written Opinion", Feb. 5, 2025, 10 pages.

* cited by examiner

*Primary Examiner* — Brad Harcourt
(74) *Attorney, Agent, or Firm* — DeLizio, Peacock, Lewin & Guerra LLP

(57) ABSTRACT

A system comprising a power cable to be positioned downhole in a wellbore formed in a subsurface formation, wherein the power cable generates a magnetic field. The system comprises a first energy harvesting device coupled with the power cable and configured to harvest power from the magnetic field, wherein the power is to be supplied to one or more downhole devices.

19 Claims, 17 Drawing Sheets

ENERGY HARVESTING DEVICE FOR DOWNHOLE APPLICATION

FIELD

Some implementations relate generally to the field of downhole operations within a subsurface formation and more particularly to the field of electrification of downhole devices in a wellbore.

BACKGROUND

In downhole operations within a subsurface formation, there is an increased level of electrification taking place. This involves converting downhole systems powered typically by hydraulic power to electric motors and associated electronics. This evolution is seen and proven to be more effective as well as more reliable than hydraulic power, which may require capillary lines from surface and valves that may be prone to damage during installation and operation.

BRIEF DESCRIPTION OF THE DRAWINGS

Implementation of the disclosure may be better understood by referencing the accompanying drawings.

DESCRIPTION

Figure 1:
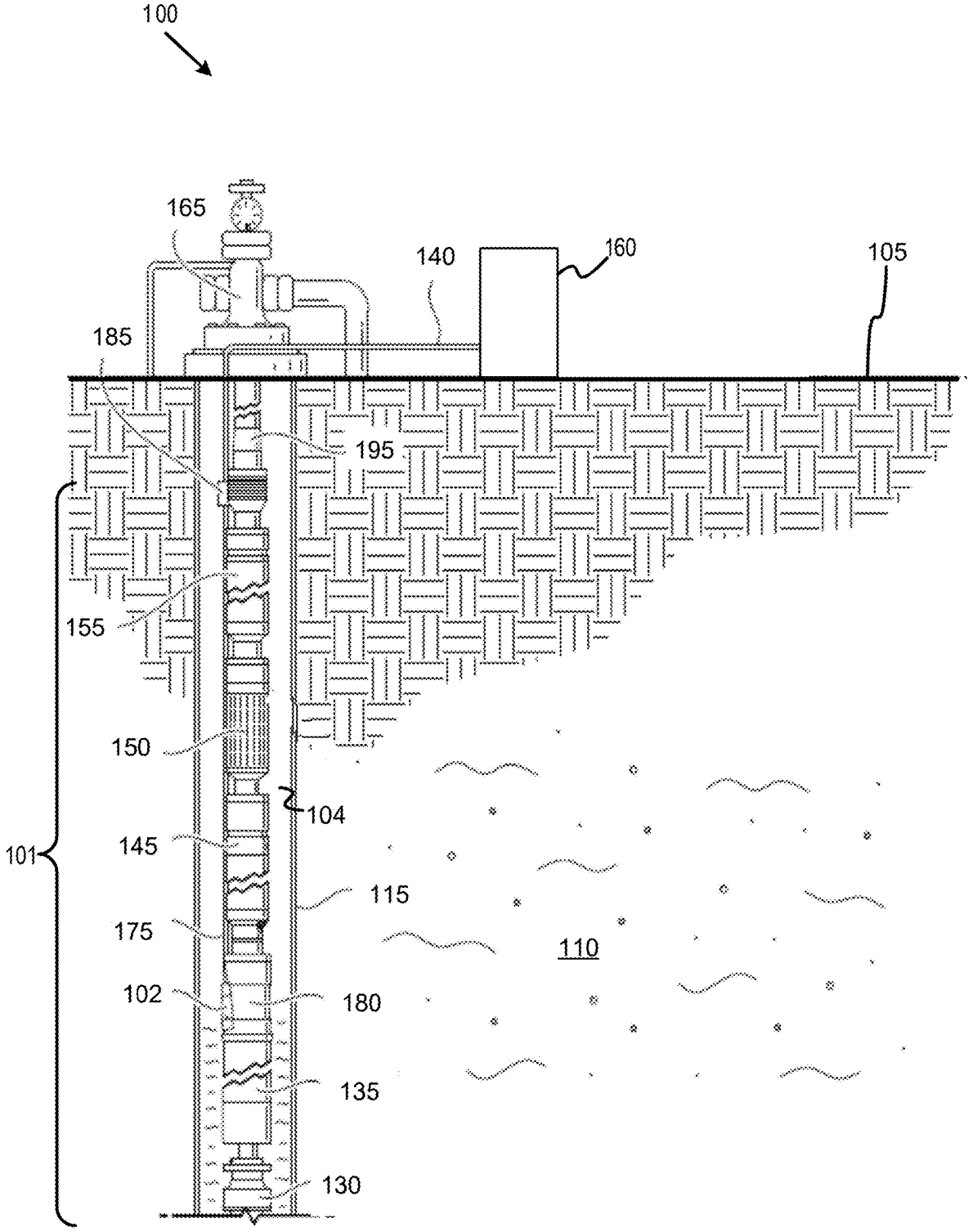
FIG. 1 is a perspective view in partial cross section of an example well system with an electrical submersible pump (ESP), according to some implementations.

The description that follows includes example systems, methods, techniques, and program flows that embody aspects of the disclosure. However, it is understood that this disclosure may be practiced without these specific details. For instance, this disclosure refers to cables to provide power to an electrical submersible pump in a wellbore formed in a subsurface formation. Aspects of this disclosure can also be applied to other downhole tools that require power from the surface. For clarity, some well-known instruction instances, protocols, structures, and techniques have been omitted.

Example implementations relate to an energy harvesting device configured (to be positioned downhole in a wellbore) to harvest power by utilizing the time varying magnetic field of a cable when an alternative current is flowing through the cable. The electrification of devices in a wellbore may require electrical power to be supplied to the downhole subsystems. Conventional approaches may provide power to one or more devices directly from the surface via a dedicated cable, and/or powered indirectly from the surface utilizing downhole hydraulic turbine-driven generators. However, providing power to such downhole devices may represent a challenge given the nature of wellbore environments (depth, temperature, pressure, area, etc.). Alternatively, conventional approaches may utilize energy storage devices like batteries. However, this may represent challenges particularly in the downhole environment where the relatively high temperatures may shorten the battery life. Thus, it may be desirable to provide alternative sources of electrical energy for powering downhole devices which may be used in circumstances where the delivery of power directly from the surface using a cable and/or a hydraulic line may present challenges while avoiding the limitations of batteries if battery power is the alternative option. In some implementations, an energy harvesting device configured for harvesting electrical energy in a well having an electric submersible pump (ESP) installed and operating may be utilized to supply power to other downhole devices in the well, thus avoiding the limitations of direct power supply from the surface and/or battery power. The energy harvesting device may be passive with no rotating components, no direct electrical connection to the ESP cable, and may rely on the power transiting through the ESP cable on its way to the motor.

In some implementations, an energy harvesting device may be coupled with a power cable positioned in a wellbore (such as an ESP cable) and configured to capture the stray magnetic field of the cable while alternating current (AC) may be flowing through the cable. The energy harvesting device may be attached to either side of the cable such that the energy harvesting device at least partially surrounds a conductor within the power cable. In some implementations, the energy harvesting device may be integrated into the power cable and/or configured as an assembly (i.e., a cable section with an energy harvesting device) to connect to the cable. When coupled with the power cable, the energy harvesting device may form a magnetic circuit. The energy harvesting device may be configured with a core and a coil wound around a portion of the core. The magnetic field generated by, and surrounding a conductor of the power cable may be captured by the core and then converted to electromotive force (EMF) in the secondary isolated coil. The generated EMF may be processed further by rectification or active rectification which may then be utilized to supply raw or controlled DC voltages to one or more downhole devices positioned in the wellbore. For example, the power harvested by the energy harvesting device may be supplied to devices such as one or more sensors, inflow control devices, actuators, valves, battery charging systems (to supply other devices), etc.

In some implementations, the energy harvesting device may be modular, and multiple energy harvesting devices may be electrically coupled (in series or in parallel) to meet the power requirements of the downhole devices. For example, the power of 2 Watts (W), 10 W, 90 W, etc. may be harvested by one or more energy harvesting devices. In some implementations, the energy harvesting devices may be integrated with the cable in locations from the surface to the pump intake of the ESP. Multiple energy harvesting devices may be utilized to service local devices (such as devices positioned proximate ESP including sensor gauges mounted on the motor base) and/or remote devices below the ESP (i.e., at deeper depths than the ESP). For example, one or more sensor gauges may be positioned on the motor base and powered from the motor windings. If there is a ground fault and the sensor gauge(s) may no longer be powered by the motor windings, the energy harvest devices may supply the power.

In some implementations, the energy harvesting device may be utilized in other applications other than ESPs. For example, the energy harvesting device may be applicable to other activities and/or downhole tools that utilize a cable to supply alternating current (AC) power downhole from the surface. The energy harvesting device may be utilized in operations outside of oil and gas operations. For example, the cable structure may be utilized in ESP geothermal recovery operations, water source wells, dewatering applications, etc.

Example Systems

FIG. 1 is a perspective view in partial cross section of an example well system with an electrical submersible pump (ESP), according to some implementations. While a well system 100 of FIG. 1 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs.

An ESP assembly 101 is located downhole in a wellbore 104 below a surface 105. The wellbore 104 may, for example, be several hundred or a few thousand meters deep. The wellbore 104 is depicted as vertical, but it may also be horizontal or may be curved, bent and/or angled, depending on the wellbore direction. The wellbore 104 may be an oil well, water well, and/or well containing other hydrocarbons, such as natural gas, and/or another production fluid taken from a subsurface formation 110. The ESP assembly 101 may be separated from the subsurface formation 110 by a well casing 115. Production fluid enters the well casing 115 through casing perforations (not shown). Casing perforations may be either above or below a pump intake 150. The ESP assembly 101 includes, from bottom to top, a downhole gauge 130 which may include one or more sensors that may detect and provide information such as motor speed, internal motor temperature, pump discharge pressure, downhole flow rate and/or other operating conditions to a user interface, variable speed drive controller, and/or data collection computer, herein individually or collectively referred to as controller 160, on surface 105. An ESP motor 135 may comprise an induction motor, such as a two-pole, three phase squirrel cage induction motor, a direct current (DC) motor, and a permanent magnet motor. An ESP cable 140 may be communicatively coupled to the controller 160. The ESP cable 140 may provide power to the ESP motor 135 and/or carries data to and/or from the downhole gauge 130 to the surface 105. A pothead 102 encloses the electrical connection between ESP cable 140 and a head 180 of the ESP motor 135.

In conventional ESP applications, the ESP cable 140 may extend from the controller 160 at surface 105 to a motor lead extension (MLE) 175. A cable connection 185 connects the ESP cable 140 to the MLE 175. The MLE 175 may plug in, tape in, spline in or otherwise electrically connect the ESP cable 140 to the ESP motor 135 to provide power to the ESP motor 135. In some implementations, the well system 100 may not include an MLE 175, and the ESP cable 140 may be directly electrically connected to the pothead 102. This may assist in avoiding the need to splice the cables on top of the motor.

In some implementations, one or more energy harvesting devices may be coupled with the ESP cable 140 and/or the MLE 175. For example, an energy harvesting device may be attached to the side of the ESP cable 140 to capture the magnetic field surrounding a conductor of the ESP cable 140 when current is flowing through the ESP cable 140 to supply power to the ESP motor 135. In some implementations, the energy harvesting device may convert the magnetic flux to EMF, which may then be rectified or actively rectified to supply power to other downhole devices in the well 104. In some implementations, more than one energy harvesting device may be coupled with the ESP cable 140.

Upstream of the ESP motor 135 is a motor protector seal 145, a pump intake 150, an ESP pump 155 and production tubing 195. The motor protector seal 145 may serve to equalize pressure and keep the motor oil separate from well fluid. The pump intake 150 may include intake ports and/or a slotted screen and may serve as the intake to the ESP pump 155. The ESP pump 155 may comprise a multi-stage centrifugal pump including stacked impeller and diffuser stages. Other components of ESP assemblies may also be included in the ESP assembly 101, such as a tandem charge pump (not shown) or gas separator (not shown) located between the pump intake 150 and the ESP pump 155 and/or a gas separator that may serve as the pump intake. Shafts of the ESP motor 135, the motor protector seal 145, the pump intake 150 and the ESP pump 155 may be connected (i.e., splined) and rotated by the ESP motor 135. The production tubing 195 may carry lifted fluid from the discharge of the ESP pump 155 toward a wellhead 165.

Example Cable Structures

Examples of cable structures are now described. The cables of the cable structure are described in reference to the ESP cable 140 of FIG. 1. The cable structures are described herein with multiple cables configured in various structures (e.g., three cables configured in a flat structure, triangular structure, etc.). The structures are not limited to flat, but may also be configured in any other suitable structure such as round, twisted, layered, coaxial, etc. The cable structures are not limited to three-phase but may include one cable and/or more than one cable. The insulators described herein may be any suitable material to provide thermal and/or electrical insulation for the components within the cable structures.

Figure 2:
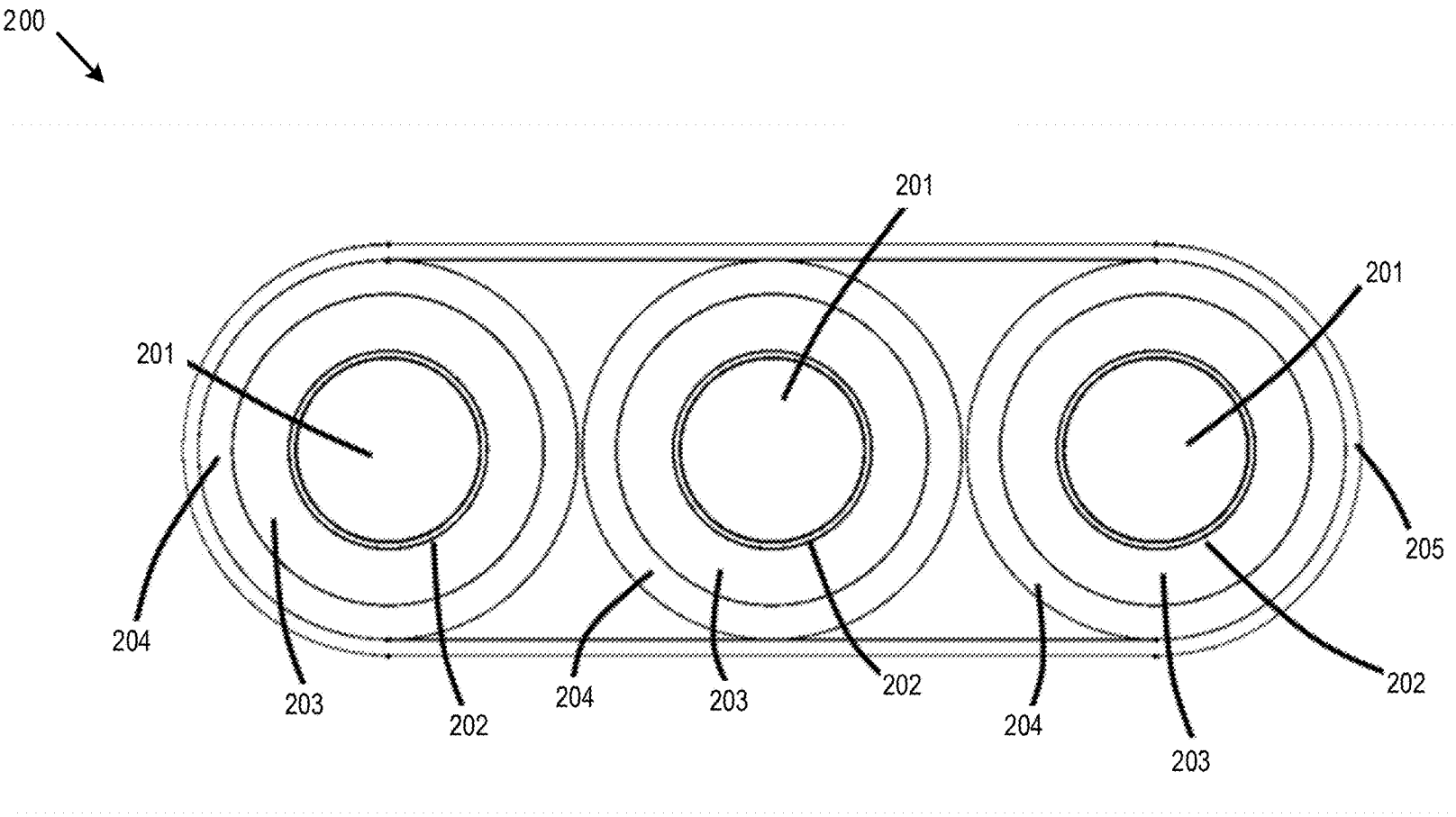
FIG. 2 is a cross-sectional view of an example flat cable structure, according to some implementations.

FIG. 2 is a cross-sectional view of an example flat cable structure, according to some implementations. In particular, FIG. 2 includes a cross-sectional view of a flat cable structure 200. The flat cable structure 200 may be coupled to components of a downhole tool positioned in a wellbore (such as the pothead 102 to supply power to the ESP motor 135 of the ESP assembly 101 of FIG. 1). The flat cable structure 200 depicts a flat cable structure that includes three conductors 201. The conductor 201 may use any suitable conductive material such as copper. The flat cable structure 200 is not limited to the components described herein but may include more or less components. For example, the flat cable structure 200 may or may not include the electrical insulator 202.

Each conductor 201 may be encased with an electrical insulator 202 comprising materials such as a polymer, elastomer, or any other suitable electrically insulating material. In some implementations, the electrical insulator 202 may be utilized in wellbores that may experience high-temperature environments (e.g., temperatures greater than 350 degrees Fahrenheit). An electrical insulator 203 may surround the electrical insulator 202. The electrical insulator 203 may comprise materials such as a polymer, elastomer, or any other suitable electrically insulating material. The layer 204 may surround the electrical insulator 203. The layer 204 may function as a protective layer to conductor 201 to prevent conductor 201 from exposure to wellbore fluids. The layer 204 may be comprised of lead or any other suitable material. An armor 205 may surround each of the conductors 201 and associated electrical insulators 203 and layers 204. The armor 205 may be comprised of stainless steel, Monel, or any other suitable material. In some implementations, each of layers 204 may be wrapped in bedding tape to protect the armor 205 from layer 204.

Figure 3:
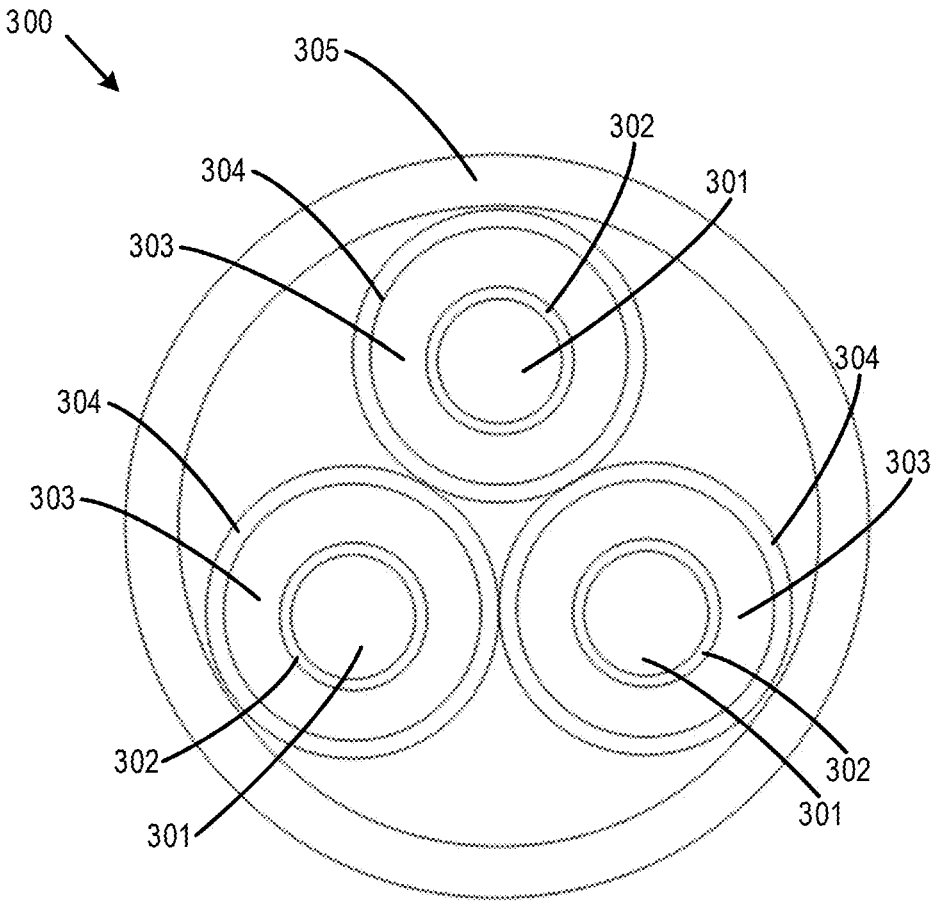
FIG. 3 is a cross-sectional view of an example triangular cable structure, according to some implementations.

FIG. 3 is a cross-sectional view of an example triangular cable structure, according to some implementations. In particular, FIG. 3 includes a cross-sectional view of a triangular cable structure 300. The triangular cable structure 300 may have similar components and functions as the flat cable structure 200 of FIG. 2. For example, the triangular cable structure 300 may be coupled to components of a downhole tool positioned in a wellbore (such as the pothead 102 to supply power to the ESP motor 135 of the ESP assembly 101 of FIG. 1). The triangular cable structure 300 depicts a triangular cable structure that includes three conductors 301 arranged in a triangular configuration. The conductor 301 may use any suitable conductive material such as copper. The triangular cable structure 300 is not limited to the components described herein but may include more or fewer components.

Each conductor 301 may be encased with an electrical insulator 302 comprising materials such as a polymer, elastomer, or any other suitable electrically insulating material. In some implementations, the electrical insulator 302 may be utilized in wellbores that may experience high-temperature environments (e.g., temperatures greater than 350 degrees Fahrenheit). An electrical insulator 303 may surround the electrical insulator 302. The electrical insulator 303 may comprise materials such as a polymer, elastomer, or any other suitable electrically insulating material. The layer 304 may surround the electrical insulator 303. The layer 304 may function as a protective layer to the conductor 301 to prevent the conductor 301 from exposure to wellbore fluids. The layer 304 may be comprised of lead or any other suitable material. An armor 305 may surround all of the conductors 301 and associated electrical insulators 303 and layers 304. The armor 305 may be comprised of stainless steel, Monel, carbon steel, or any other suitable material. In some implementations, each of the layers 304 may be wrapped in bedding tape to protect the armor 305 from the layer 304.

Example Energy Harvesting Devices

Examples of energy harvesting devices are now described. The cables in which the energy harvesting devices are coupled are described in reference to the ESP cable 140 of FIG. 1 and the cable structures described in reference to FIGS. 2-3.

Figure 4:
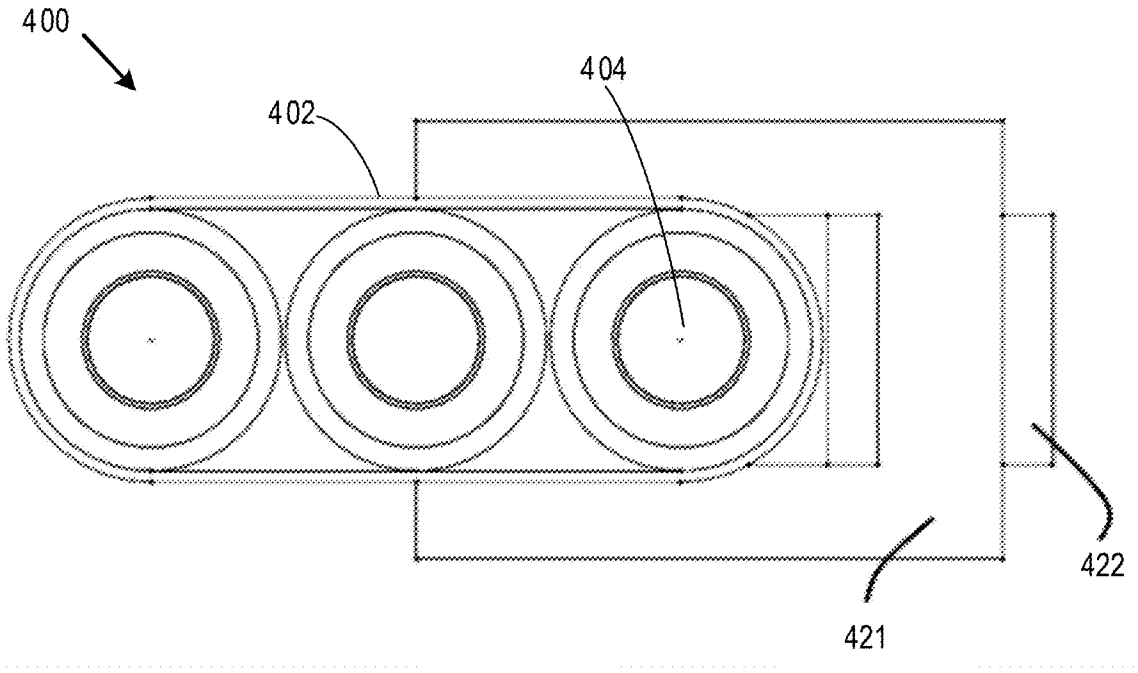
FIG. 4 is a cross-sectional view of an example energy harvesting device coupled with a cable, according to some implementations.

FIG. 4 is a cross-sectional view of an example energy harvesting device coupled with a cable, according to some implementations. In particular, FIG. 4 includes a cross-sectional view of an energy harvesting device 400. The energy harvesting device 400 comprises a core 421 and a coil 422 coupled with a flat cable 402. The flat cable 402 may be representative of the ESP cable 140 described in reference to FIG. 1 and/or the flat cable structure 200 described in reference to FIG. 2. A flat cable 402 is depicted with three conductors, such as conductor 404 (and associated layers as described in reference to FIG. 2). The core 421 is coupled with the flat cable 402 to partially surround the conductor 404. When a current is flowing through the conductor 404, a magnetic field may be generated by, and surround, the conductor 404. The core 421 may capture the magnetic field of the conductor 404. A coil 422 may be wound around a portion of the core 421 such that the alternating magnetic flux within the core 421 may induce an EMF in the coil 422.

Although the core 421 and the coil 422 are depicted as being attached to the outside of the flat cable 402 (i.e., on the outside of the armor surrounding the three conductors), the core 421 and the coil 422 may be coupled with the flat cable 402 at any suitable position such that the core 421 may partially surround a conductor 404 in the flat cable 402 to capture the magnetic field generated by the conductor 404. For example, the core 421 and coil 422 may be integrated into the flat cable 402 (e.g., inside the armor of the cable). The core 421 and the coil 422 may be coupled with the flat cable 402 via any suitable method, such as banding, sheathing, etc.

Figure 5A:
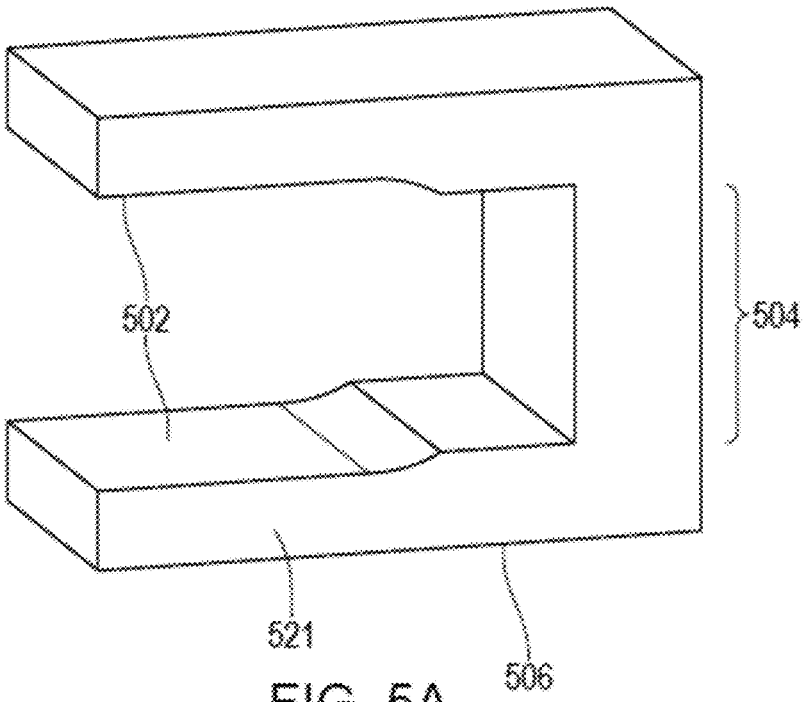
FIGS. 5A-5B are perspective views of example energy harvesting device components, according to some implementations.
Figure 5B:
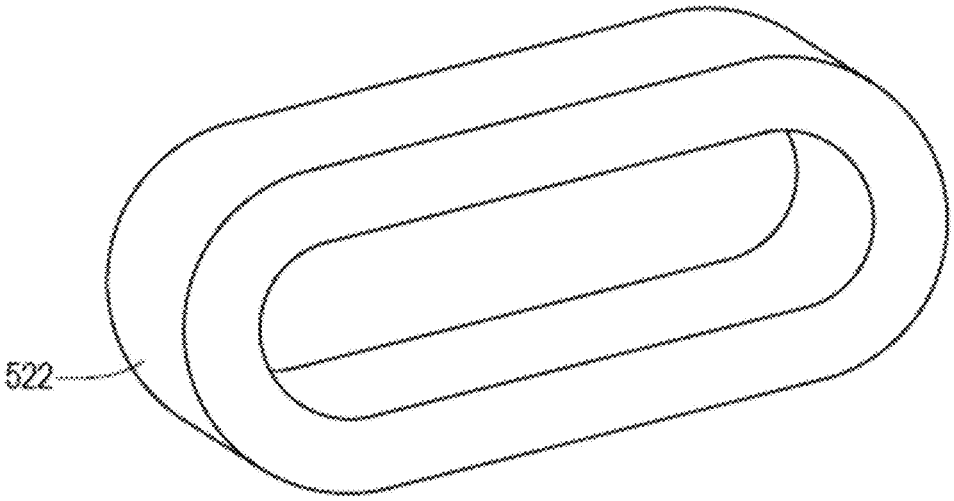

FIGS. 5A-5B are perspective views of example energy harvesting device components, according to some implementations. FIGS. 5A-5B depict a core 521 (such as the core 421 of FIG. 4) and a coil 522 (such as the coil 422 of FIG. 4), respectively. The core 521 may comprise ferrites, stacked laminations, sintered Soft Magnetic Composites (SMC), or any other suitable material configured to capture the magnetic field generated by a cable. In some implementations, the material of the core 521 may provide flexibility. The core 521 may be configured with faces 502 spaced a distance apart such that the core 521 may at least partially surround the cable. The core 521 may be any suitable shape. For example, one or more of the outer faces of core 521, such as outer face 506, may be shaped with a contour approximately similar to the contour of the components in the wellbore. For instance, the outer face 506 may have a curved contour to be approximately similar to the curved contour of the outside face of a joint of tubing where the cable and energy harvesting device may be banded to.

A core 521 may be configured with a section 504 for a coil 522 such that the coil 522 may be wound around the core 521. The coil 522 may include wire and/or enamel wire comprising materials such as copper, aluminum, or any other suitable material. In some implementations, the coil 522 may be encapsulated to protect the cable from wellbore fluids.

Figure 6:
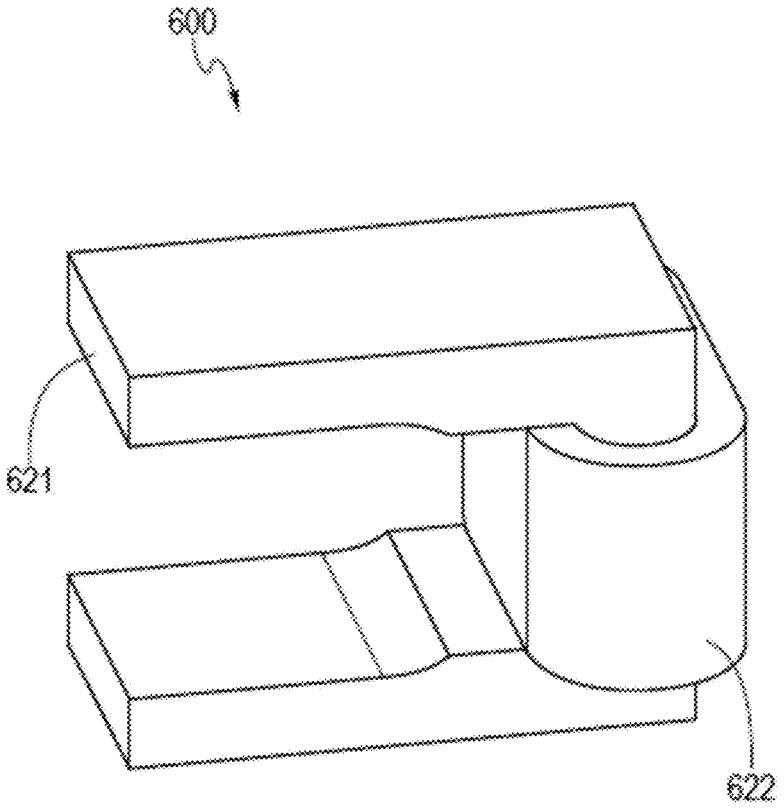
FIG. 6 is a perspective view of an example energy harvesting device, according to some implementations.

FIG. 6 is a perspective view of an example energy harvesting device, according to some implementations. In particular, FIG. 6 includes an energy harvesting device 600 comprising a core 621 and a coil 622. Core 621 may be similar to core 521 described in reference to FIG. 5A. Similarly, coil 622 may be similar to coil 522 described in reference to FIG. 5B. Coil 622 may be wound around core 621 to form the energy harvesting device 600. In some implementations, the energy harvesting device 600 may be encapsulated to protect the core 621 and/or the coil 622 from wellbore fluid ingress.

Figure 7:
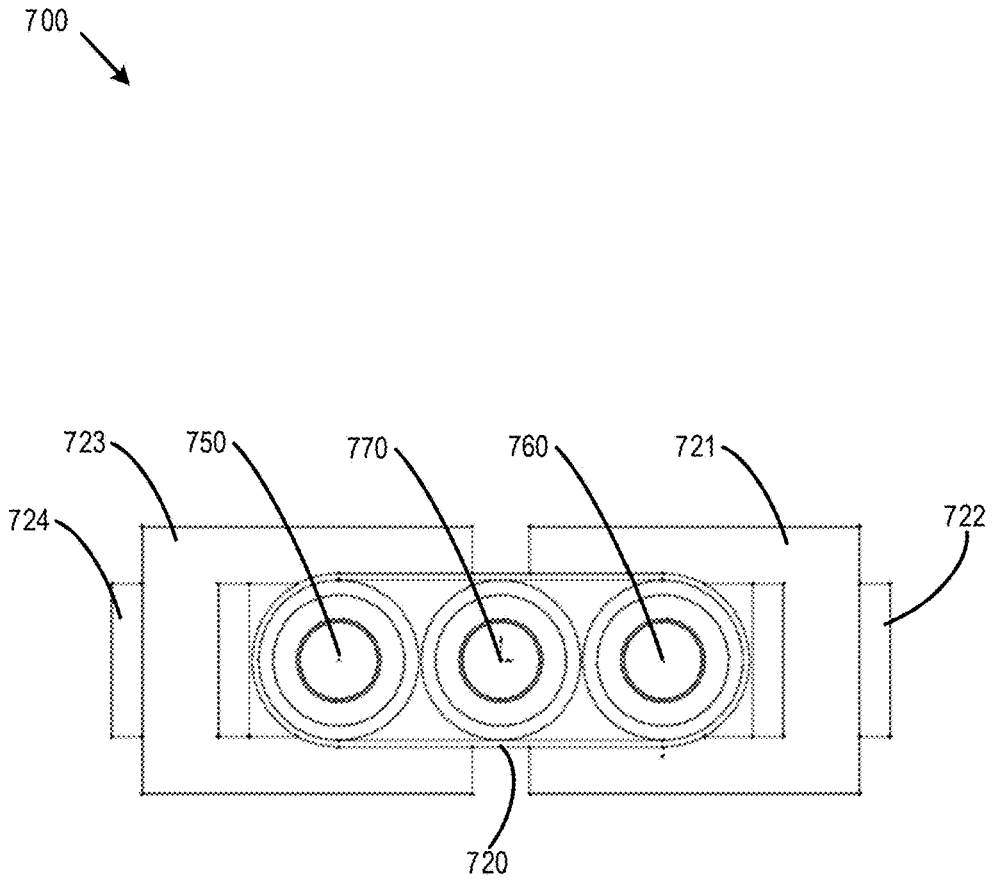
FIG. 7 is a cross-sectional view of example multiple energy harvesting devices coupled with a cable, according to some implementations.

FIG. 7 is a cross-sectional view of multiple energy harvesting devices coupled with a cable, according to some implementations. In particular. FIG. 7 includes a cross-sectional view of multiple energy harvesting devices 700. Each of the energy harvesting devices may include a core and a corresponding coil (as described in reference to FIGS. 4-6) coupled with a flat cable 720. The flat cable 720 may be representative of the ESP cable 140 described in reference to FIG. 1 and/or the flat cable structure 200 described in reference to FIG. 2. The flat cable 720 may include conductors 750-770 and associated components as described in reference to FIG. 2. An energy harvesting device comprising a core 721 and coil 722 may be coupled to one side of the flat cable 720 such that core 721 partially surrounds the conductor 760 to capture the magnetic field generated by the conductor 760. The magnetic field captured in core 721 may then induce an EMF in coil 722. Similarly, an energy harvesting device comprising core 723 and coil 724 may be coupled to the other side of the flat cable 720 such that core 723 partially surrounds the conductor 750 to capture the magnetic field generated by conductor 750. The magnetic field captured in core 723 may then induce an EMF in coil 724.

In some implementations, the outputs from the two energy harvesting devices may be in series or in parallel to meet the power requirements of one or more downhole devices. In some implementations, the energy harvesting devices may supply power to different downhole devices. For example, the energy harvesting device configured with core 721 and coil 722 may be electrically coupled with a downhole device and the other energy harvesting device configured with core 723 and coil 724 may be electrically coupled with another downhole device.

Figure 8:
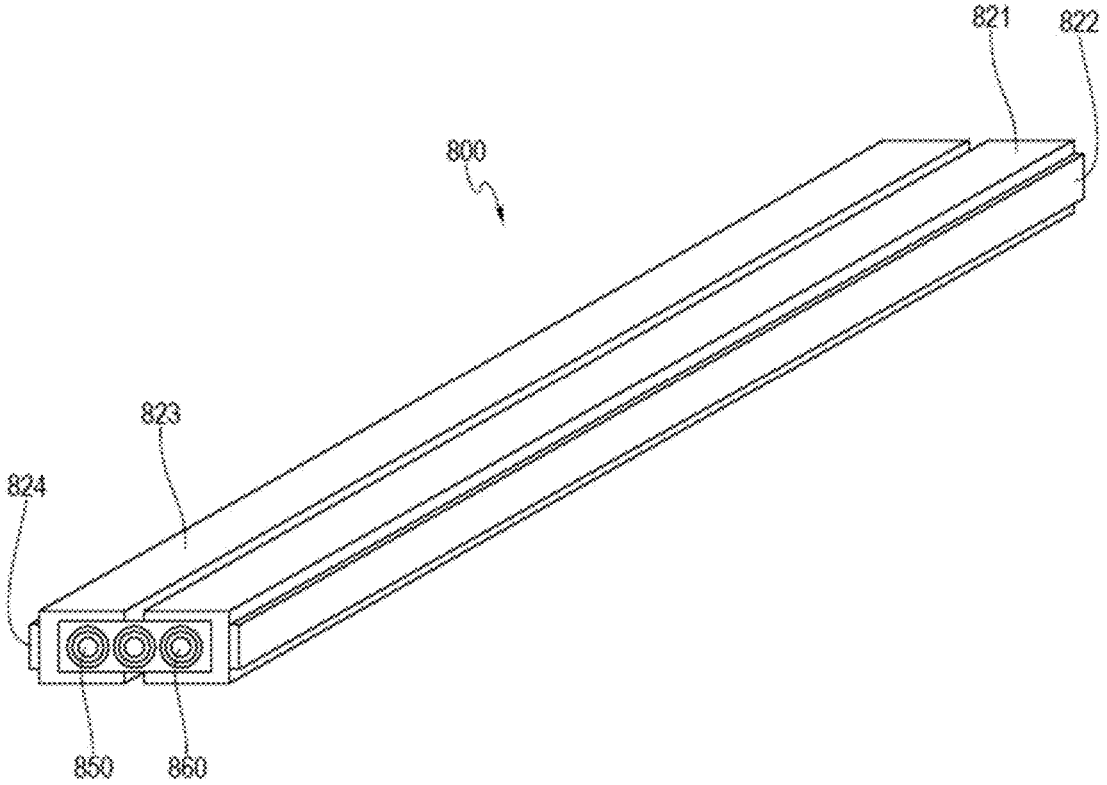
FIG. 8 is a perspective view of example energy harvesting devices coupled with a cable, according to some implementations.

FIG. 8 is a perspective view of example energy harvesting devices coupled with a cable, according to some implementations. In particular, FIG. 8 includes a schematic of a partial cross-section of energy harvesting devices 800. The cable comprises three conductors, including conductor 850 and conductor 860. The cable may be representative of the ESP cable 140 described in reference to FIG. 1 and/or the flat cable structure 200 described in reference to FIG. 2. A first energy harvesting device may include a core 821 and coil 822 coupled to the side of the cable to partially surround the conductor 860. A second energy harvesting device may include a core 823 and coil 824 coupled to the side of the cable to partially surround the conductor 850. The energy harvesting devices may be representative of the energy harvesting devices described in reference FIGS. 4-7. The energy harvesting devices may be electrically coupled in series or in parallel to supply power to one or more downhole devices. In some implementations, the energy harvesting device comprising core 821 and coil 822 may be coupled to, and supply power to, a downhole device while the energy harvesting device comprising core 823 and coil 824 may be coupled to, and supply power to, another downhole device. Each of the energy harvesting devices may be electrically coupled to one or more circuits (as described in reference FIGS. 11A-11B and FIGS. 12A-12B) to rectify or actively rectify the EMF generated by each coil 822, 824 and used to supply un-regulated or regulated voltages the downhole devices.

The energy harvesting devices depicted in FIG. 8 have a length of approximately 1 meter (m). In some implementations, the energy harvesting devices (i.e., cores 821, 823 and corresponding coils 822, 824) may be any suitable length to harvest the required amount of power for downhole devices. For example, the energy harvesting devices may be 0.5 m, 10 m, 100 m, the entire length of the cable in the wellbore, etc. In some implementations, one or more energy harvesting devices may be multiple lengths and connected together. For example, two or more energy harvesting devices may be in series for increased voltage or parallel for increased current. The energy harvesting devices may be any suitable length and/or configuration to harvest power to be supplied to the downhole devices.

In some implementations, an energy harvesting device assembly may include a core, coil, and a section of cable that is not a part of the cable positioned in the wellbore. For example, the cable depicted in FIG. 8 may be separate from a cable in a wellbore (i.e., a 1 m section of cable). Accordingly, the energy harvesting device assembly (i.e., the core(s), associated coil(s), and cable section in which the cores/cables are coupled to) may be integrated into a cable in a wellbore (such as ESP cable 140). The energy harvesting device assembly may be integrated into a cable by connecting the cable of the energy harvesting device assembly to the cable in the wellbore via quick connectors, splicing, or any other suitable connection to integrate the energy harvesting device assembly cable into the cable in the wellbore. Multiple energy harvesting device assemblies may be electrically coupled together and integrated into the cable in the wellbore and/or they may be integrated into the cable in the wellbore at different sections (i.e., there is cable in between the energy harvesting device assemblies).

Figure 9:
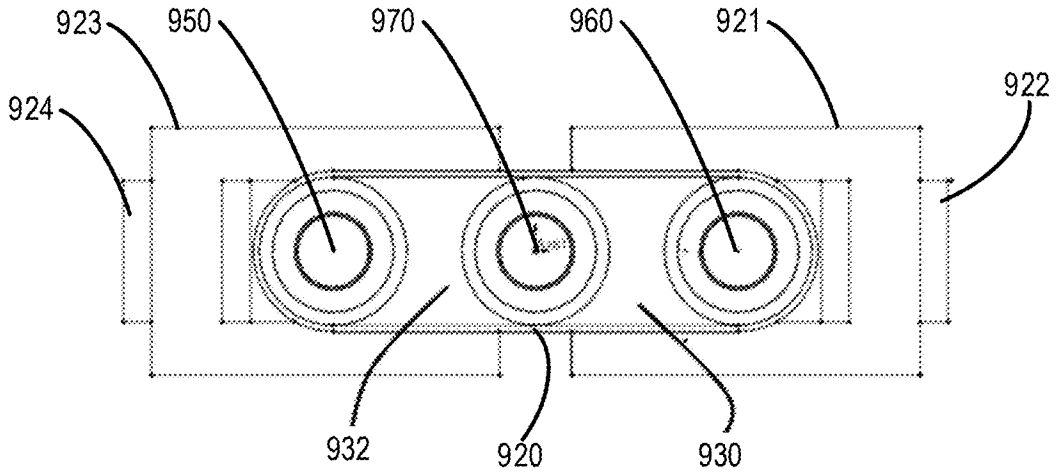
FIG. 9 is a cross-sectional view of multiple energy harvesting devices coupled with a cable configured with magnetic material, according to some implementations.

FIG. 9 is a cross-sectional view of multiple energy harvesting devices coupled with a cable configured with magnetic material, according to some implementations. In particular. FIG. 9 includes a cross-sectional view of multiple energy harvesting devices 900. Cable 920 may be representative of the ESP cable 140 described in reference to FIG. 1 and/or the flat cable structure 200 described in reference to FIG. 2. The cable may include conductors 950-970 (and associated components as described in reference to FIG. 2). The multiple energy harvesting devices 900 may be representative of the multiple energy harvesting devices 700 described in reference to FIG. 7. For example, an energy harvesting device comprising core 921 and coil 922 may be coupled to one side of the cable 920 such that core 921 partially surrounds conductor 960 to capture the magnetic field generated by conductor 960. Similarly, an energy harvesting device comprising core 923 and coil 924 may be coupled to the other side of cable 920 such that core 923 partially surrounds conductor 950 to capture the magnetic field generated by conductor 950.

In some implementations, magnetic materials 930 and 932 may be positioned in the cable between the conductors 950-970 to augment the amount of energy captured from cable 920. The magnetic materials 930 and 932 may include material such iron, steel, etc. The augmentation may increase the magnetic flux generated by each conductor 950, 960. Accordingly, more power may be supplied to the downhole devices via cores 921, 923 and associated coils 922 924. Although FIG. 9 depicts two magnetic materials 930, 932, cable 920 may include one magnetic material or more than two magnetic materials. For example, if only one energy harvesting device (such as core 921 and coil 922) were coupled to cable 920, the cable may only include magnetic material 930, magnetic material 932, or both magnetic material 930, 932.

Figure 10A:
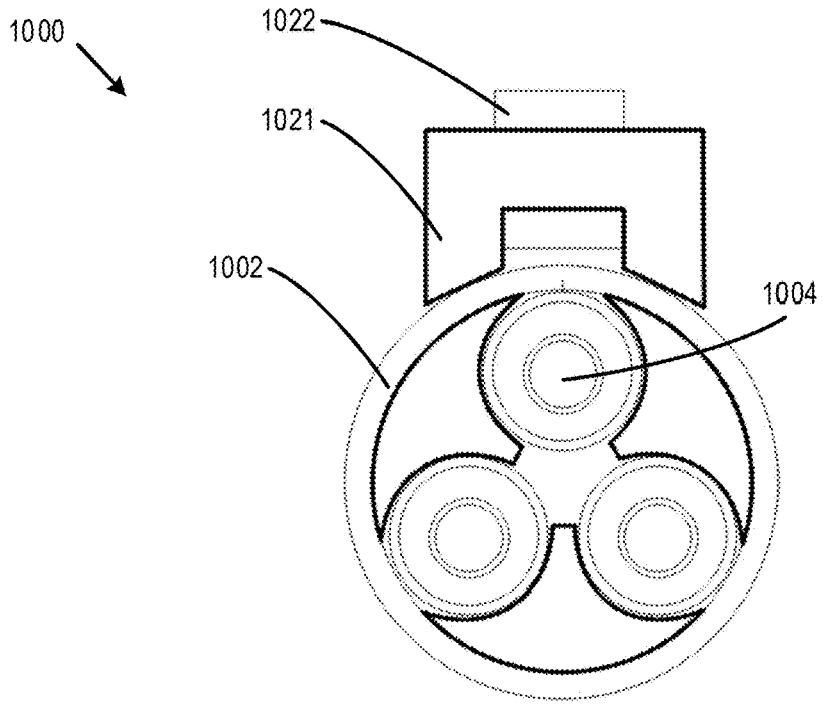
FIGS. 10A-10B are cross-sectional views of example energy harvesting devices coupled with a cable, according to some implementations.

FIGS. 10.A-10B are cross-sectional views of energy harvesting devices coupled with a cable, according to some implementations. FIG. 10A includes a cross-sectional view of an energy harvesting device 1000. The energy harvesting device 1000 may be similar to the energy harvesting device 400 described in reference to FIG. 4. For example, the energy harvesting device 1000 comprises a core 1021 and a coil 1022 coupled with a triangular cable 1002. The triangular cable 1002 may be representative of the ESP cable 140 described in reference to FIG. 1 and/or the triangular cable structure 300 described in reference to FIG. 3. A triangular cable 1002 is depicted with three conductors, such as conductor 1004 (and associated layers as described in reference to FIG. 3). The core 1021 is coupled with the triangular cable 1002 to partially surround the conductor 1004. When a current is flowing through the conductor 1004, a magnetic field may be generated by, and surround, the conductor 1004. The core 1021 may capture the magnetic field of the conductor 1004. A coil 1022 may be wound around a portion of the core 1021 such that the magnetic field captured by core 1021 may induce an EMF in coil 1022.

Figure 10B:
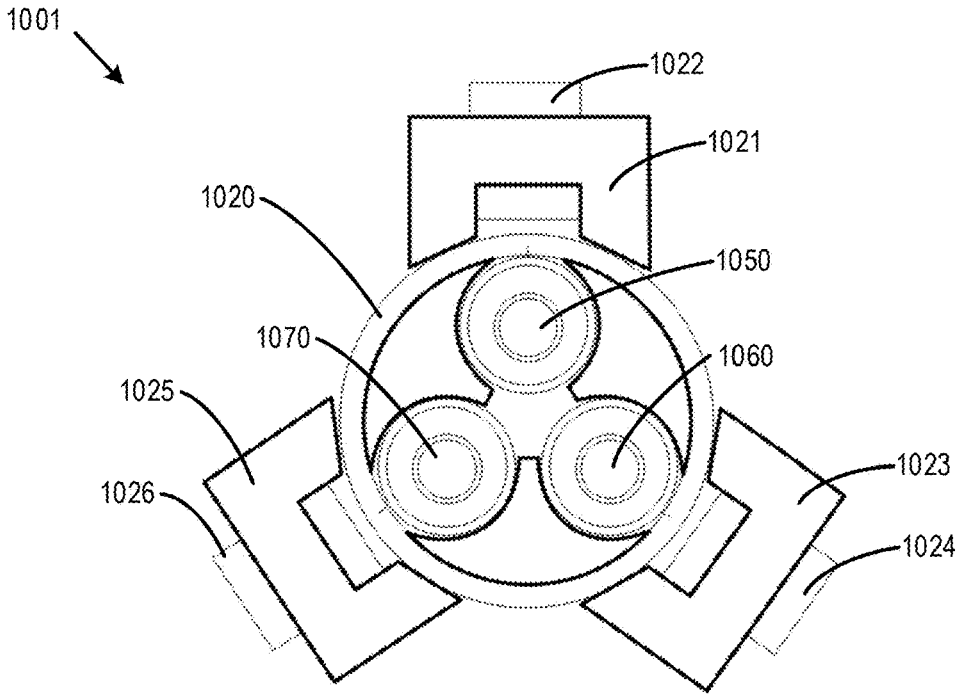

FIG. 10B includes a cross-sectional view of a multiple energy harvesting device assembly 1001. Each of the energy harvesting devices may include a core and a corresponding coil (as described in reference to FIGS. 4-6). The multiple energy harvesting devices 1000 may be similar to the energy harvesting devices 700 described in reference to FIG. 7. For example, the multiple energy harvesting devices 1000 may be coupled with a triangular cable 1020. The triangular cable 1020 may be representative of the ESP cable 140 described in reference to FIG. 1 and/or the triangular cable structure 300 described in reference to FIG. 3. The triangular cable 1020 may include conductors 1050-1070 (and associated components as described in reference to FIG. 2). An energy harvesting device comprising core 1021 and coil 1022 may be coupled to one side of the triangular cable 1020 such that core 621 partially surrounds conductor 1050 to capture the magnetic field generated by conductor 1050. The magnetic field captured in core 1021 may then induce an EMF in coil 1022. Similarly, an energy harvesting device comprising a core 1023 and coil 1024 may be coupled to the other side of the triangular cable 1020 such that core 1023 partially surrounds the conductor 1060 to capture the magnetic field generated by conductor 1060. The magnetic field captured in the core 1023 may then induce an EMF in coil 1024. Moreover, an energy harvesting device comprising a core 1025 and coil 1026 may be coupled to the other side of the triangular cable 1020 such that the core 1025 partially surrounds conductor 1070 to capture the magnetic field generated by the conductor 1070. The magnetic field captured in the core 1025 may then induce an EMF in coil 1026.

Example Circuits

Examples of circuits utilized to electrically couple one or more energy harvesting devices to one or more downhole devices are now described. The circuits are described in reference to the energy harvesting devices described in reference to FIGS. 4-10.

Figure 11A:
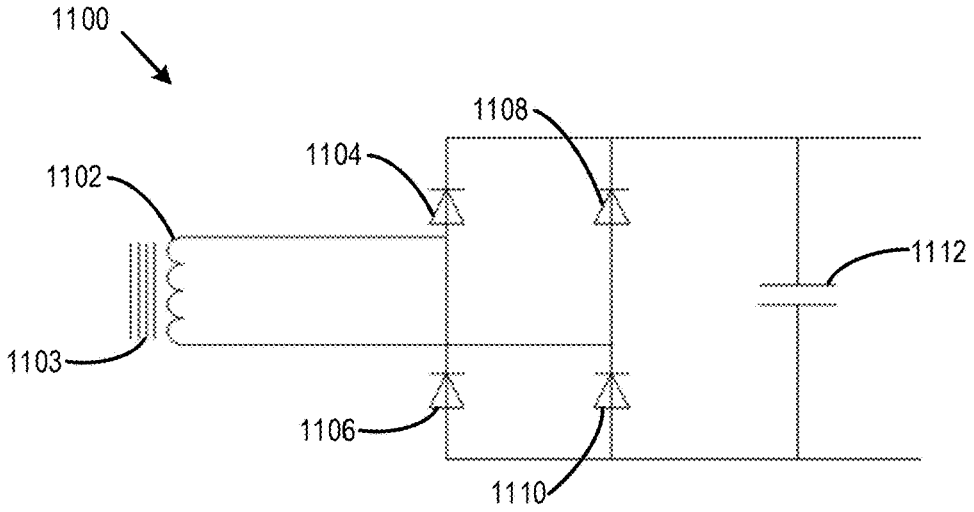
FIGS. 11A-11B are schematic views of example circuits to use with energy harvesting devices, according to some implementations.
Figure 11B:
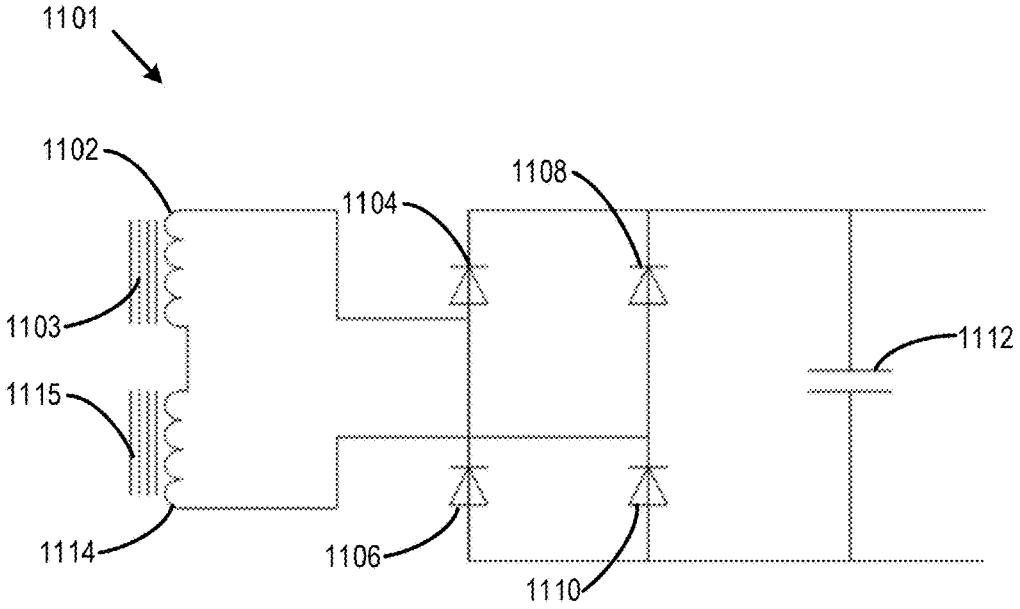

FIGS. 11A-11B are schematic views of example circuits to use with energy harvesting devices, according to some implementations. FIG. 11A includes a circuit 1100 to electronically couple an energy harvesting device to a downhole device. The circuit 1100 may include a rectifier comprising diodes 1104, 1106, 1108, and 1110. Additionally, the circuit 1100 may include a capacitor 1112. An energy harvesting device comprising a core 1103 and a coil 1102 may be electronically coupled with the circuit 1101 components (e.g., the diodes 1104-1110 and capacitor 1112) such that the EMF generated in the coil 1102, via the magnetic field generated by a conductor of a cable and captured by the core 1103, may be rectified or actively rectified by the rectifier (i.e., diodes 1104-1110 and capacitor 1112) to supply regulated voltages to one or more downhole devices (not pictured).

FIG. 11B includes a circuit 1101 to electrically couple two energy harvesting devices to a downhole device. The circuit 1101 may be configured similarly to the circuit 1100 of FIG. 11A. For example, circuit 1101 may include a rectifier comprising diodes 1104, 1106, 1108, and 1110. Additionally, the circuit 1101 may include a capacitor 1112. A first energy harvesting device comprising a core 1103 and a coil 1102 may be electronically coupled with the components of the circuit 1101 (e.g., the diodes 1104-1110 and capacitor 1112). Additionally, a second energy harvesting device comprising a core 1115 and a coil 1114 may be electronically coupled with the components of circuit 1101. FIG. 11B depicts the energy harvesting devices being electronically coupled in series. In some implementations, the energy harvesting devices may be in parallel. The EMF generated in coil 1102 and coil 1114, via the magnetic field generated by a conductor of a cable (or conductors, if each energy harvesting device is coupled with different conductors) and captured by core 1103 and core 1115, respectively, may be actively rectified by the rectifier (i.e., diodes 1104-1110 and capacitor 1112) to supply regulated voltages to one or more downhole devices (not pictured).

Figure 12A:
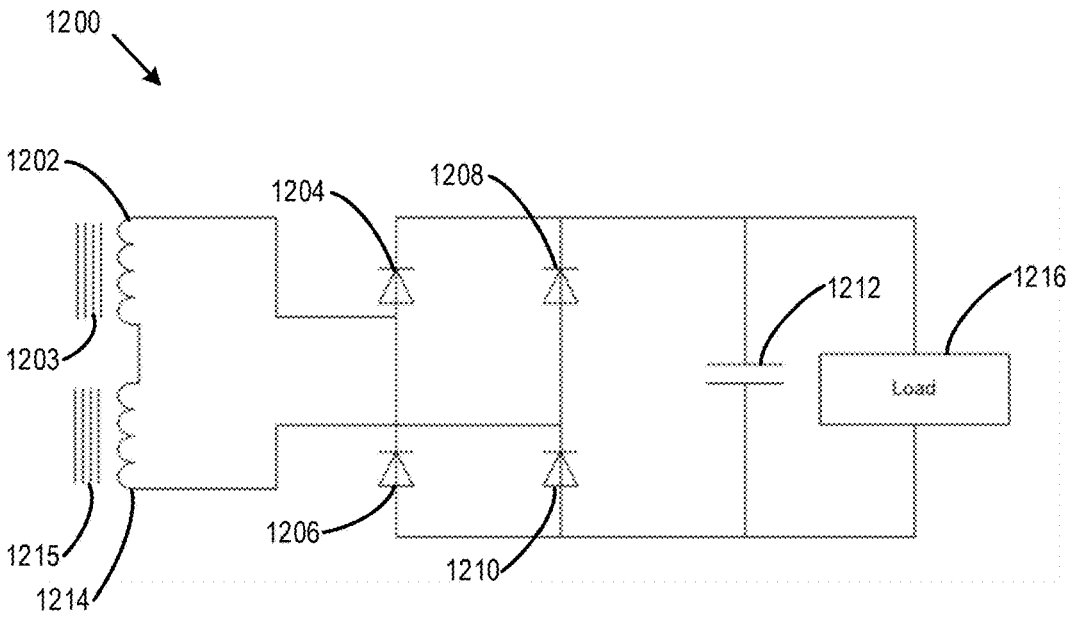
FIGS. 12A-12B are schematic views of example circuits to use with energy harvesting devices, according to some implementations.
Figure 12B:
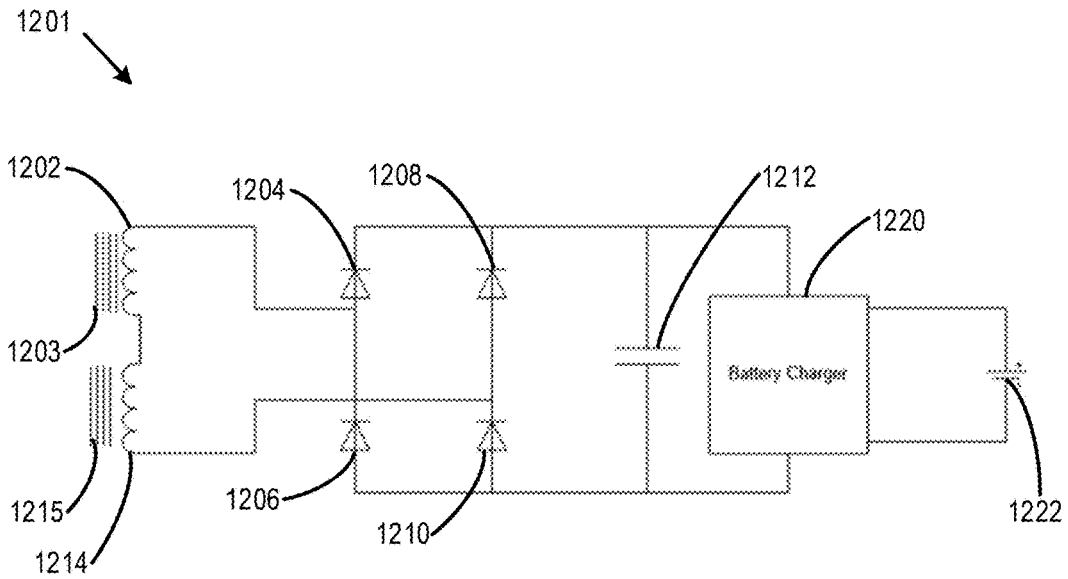

FIGS. 12A-12B are schematic views of example circuits to use with energy harvesting devices, according to some implementations. FIG. 12A includes a circuit 1200 of multiple energy harvesting devices supplying power to a load (i.e., a downhole device such as one or more sensors, valves, etc.). Circuit 1200 may be similar to circuit 1101 described in reference to FIG. 11B. For example, the circuit 1200 may include a rectifier comprising diodes 1204, 1206, 1208, and 1210. Additionally, the circuit 1200 may include a capacitor 1112. A first energy harvesting device comprising a core 1203 and a coil 1202 may be electronically coupled with the components of circuit 1200 (e.g., the diodes 1204-1210 and capacitor 1212). Additionally, a second energy harvesting device comprising a core 1215 and a coil 1214 may be electronically coupled with the circuit 1200. FIG. 12A depicts the energy harvesting devices being electronically coupled in series. In some implementations, the energy harvesting devices may be in parallel. One or more downhole devices, represented by load 1216, may be electronically coupled with the components of the circuit 1200. The EMF generated in coil 1202 and coil 1214, via the magnetic field generated by a conductor of a cable (or conductors, if each energy harvesting device is coupled with different conductors) and captured by core 1203 and core 1215, respectively, may be actively rectified by the rectifier (i.e., diodes 1204-1210 and capacitor 1212) to supply power to the load 1216. In some implementations, the number of energy harvesting devices electronically coupled with circuit 1200 may depend on the power requirements of load 1216. For example, the load may require one energy-harvesting device or two or more one energy-harvesting devices.

FIG. 12B includes a circuit 1201 of multiple energy harvesting devices supplying power to a battery 1218. The circuit 1201 may be similar to the circuit 1200 described in reference to FIG. 12A. For example, circuit 1201 may include a rectifier comprising diodes 1204, 1206, 1208, and 1210. Additionally, the circuit 1201 may include a capacitor 1112. A first energy harvesting device comprising a core 1203 and a coil 1202 may be electronically coupled with the components of circuit 1201 (e.g., the diodes 1204-1210 and capacitor 1212). Additionally, a second energy harvesting device comprising a core 1215 and a coil 1214 may be electronically coupled with the circuit 1201. FIG. 12B depicts the energy harvesting devices being electronically coupled in series. In some implementations, the energy harvesting devices may be in parallel. A battery charger 1220 and battery 1222 may be electronically coupled with the components of the circuit 1201. The EMF generated in coil 1202 and coil 1214, via the magnetic field generated by a conductor of a cable (or conductors, if each energy harvesting device is coupled with different conductors) and captured by core 1203 and core 1215, respectively, may be actively rectified by the rectifier (i.e., diodes 1204-1210 and capacitor 1212) to the battery charger 1220 configured to charge the battery 1222.

Figure 13A:
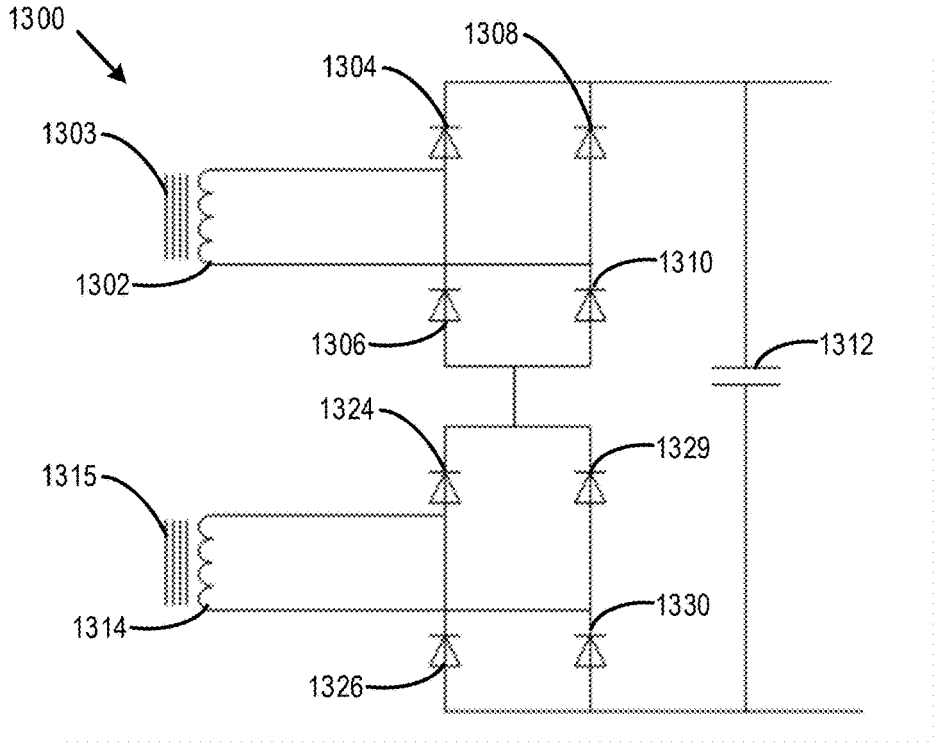
FIGS. 13A-13B are schematic views of example circuits to use with energy harvesting devices, according to some implementations.
Figure 13B:
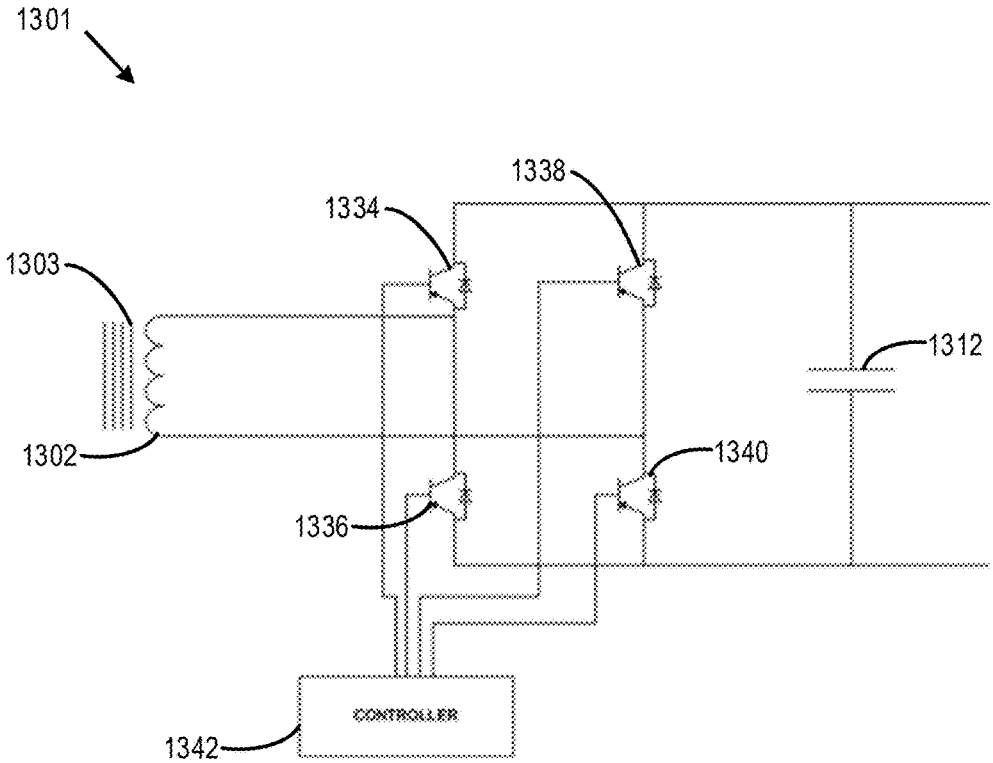

FIGS. 13A-13B are schematic views of example circuits to use with energy harvesting devices, according to some implementations. FIG. 13A includes a circuit 1300 to electrically couple two energy harvesting devices in series to a downhole device. The circuit 1300 may be configured similarly to the circuit 1100 of FIG. 11A. For example, a first energy harvesting device comprising a core 1303 and a coil 1302 may be electrically coupled with the circuit 1300. The circuit 1300 may include a rectifier comprising diodes 1304, 1306, 1308, and 1310 to actively rectify the EMF from the a first energy harvesting device. Additionally, a second energy harvesting device comprising a core 1315 and a coil 1314 may be electronically coupled with the components of circuit 1300. A rectifier comprising diodes 1324, 1326, 1328, and 1330 may actively rectify the EMF from the a second energy harvesting device. The circuit 1300 is configured such that the first energy harvesting device and the second energy harvesting device are in series and the EMF output by the respective coils 1302, 1314 are rectified prior to being in series. In some implementations, the EMF may be put in series prior to being rectified. The EMF generated in the coils 1302, 1314 may be out of phase by 120 degrees in a three phase system. Thus, configuring the EMF generated by the respective coils 1302, 1314 in series before rectification may reduce the magnitude of the potential voltage generated. Rectifying the EMF prior to putting them in series may yield higher voltage compared to the aforementioned configuration (and thus more power). Moreover, the circuit may include a capacitor 1312. The EMF generated in coils 1302, 1314, via the magnetic field generated by a conductor of a cable (or conductors, if each energy harvesting device is coupled with different conductors) and captured by cores 1303, 1315, respectively, may be actively rectified by the rectifiers (i.e., diodes 1304-1310, 1324-1330, respectively, and capacitor 1312) to supply regulated voltages to one or more downhole devices (not pictured).

FIG. 13B includes a circuit 1301 to electronically couple an energy harvesting device to a downhole device. The circuit 1301 may be configured similarly to the circuit 1100 of FIG. 11A. However, the circuit 1301 is configured with insulated-gate bipolar transistors (IGBTs) and/or metal-oxide-semiconductor field-effect transistors (MOSFETs) rather than diodes. For example, the circuit 1301 may include a rectifier comprising IGBTs 1334, 1336, 1338, and 1340. Additionally, the circuit 1300 may include a capacitor 1312. An energy harvesting device comprising a core 1303 and a coil 1302 may be electronically coupled with the circuit 1301 components (e.g., the IGBTs 1334, 1336, 1338, and 1340 and capacitor 1312) such that the EMF generated in the coil 1302, via the magnetic field generated by a conductor of a cable and captured by the core 1303, may be rectified or actively rectified (i.e., the IGBTs 1334, 1336, 1338, and 1340 and capacitor 1312) to supply regulated voltages to one or more downhole devices (not pictured). A controller 1342 may be electronically coupled with the circuit 1301. The controller 1342 may be a direct current (DC) controller configured to control the rectification by the IGBTs 1334-1340.

Figure 14A:
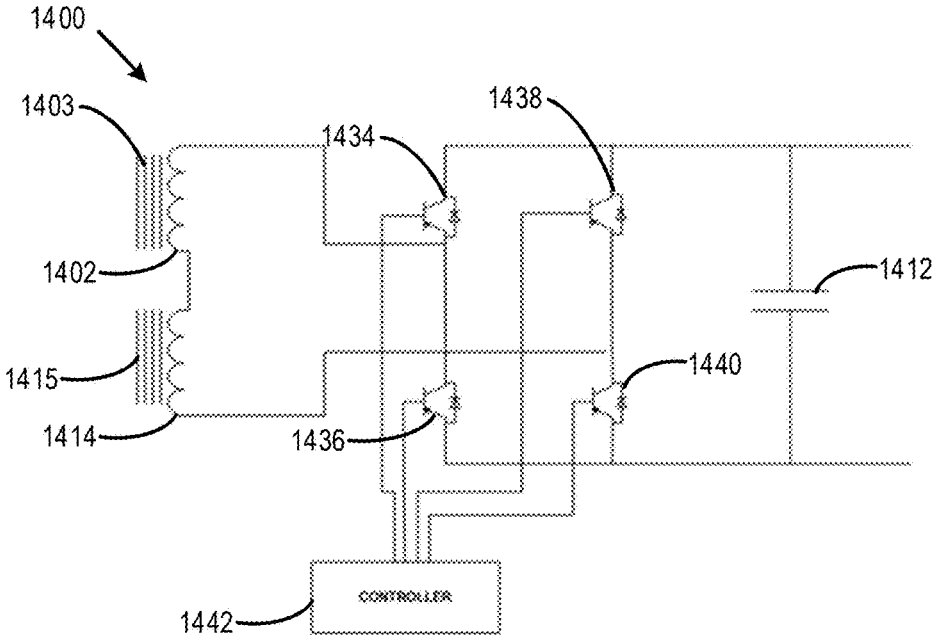
FIGS. 14A-14B are schematic views of example circuits to use with energy harvesting devices, according to some implementations.
Figure 14B:
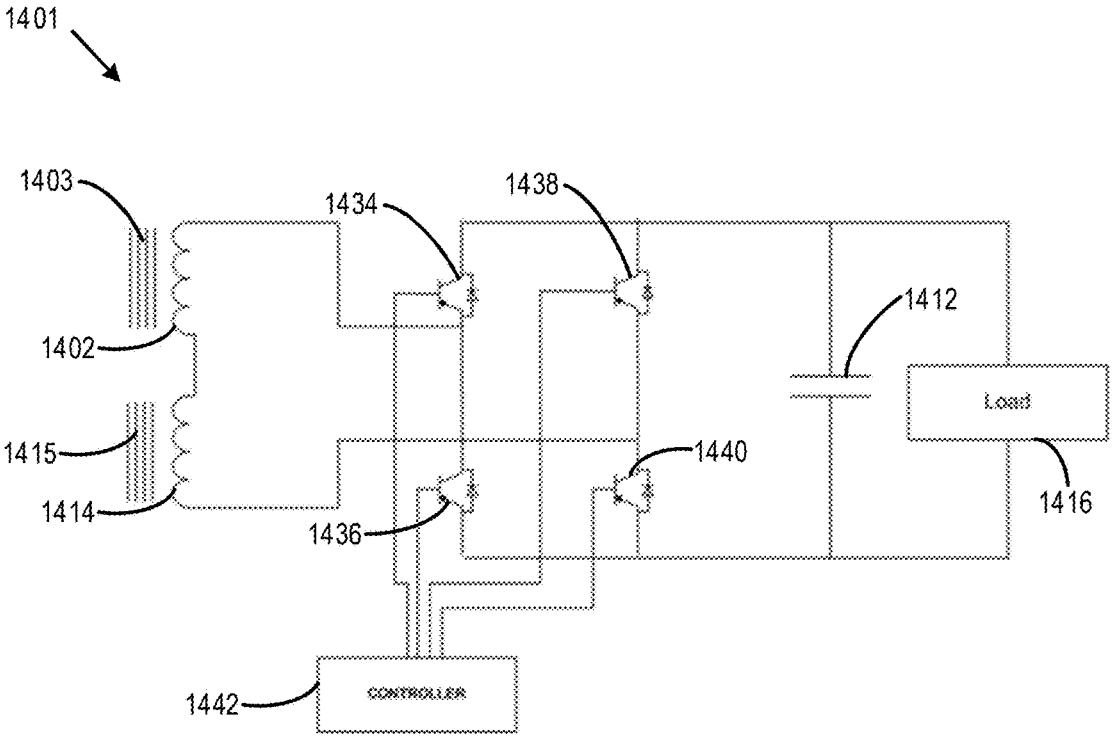

FIGS. 14A-14B are schematic views of example circuits to use with energy harvesting devices, according to some implementations. FIG. 14A includes a circuit 1400 to electrically couple two energy harvesting devices to a downhole device. The circuit 1400 may be configured similarly to the circuit 1101 of FIG. 11B. However, the circuit 1400 is configured with insulated-gate bipolar transistors (IGBTs) and/or metal-oxide-semiconductor field-effect transistors (MOSFETs) rather than diodes. For example, circuit 1400 may include a rectifier comprising IGBTs 1434, 1436, 1438, and 1440. Additionally, the circuit 1400 may include a capacitor 1412. A first energy harvesting device comprising a core 1403 and a coil 1402 may be electronically coupled with the components of the circuit 1400 (e.g., the IGBTs 1434, 1436, 1438, and 1440 and capacitor 1412). Additionally, a second energy harvesting device comprising a core 1415 and a coil 1414 may be electronically coupled with the components of circuit 1400. FIG. 14A depicts the energy harvesting devices being electronically coupled in series. In some implementations, the energy harvesting devices may be in parallel. The EMF generated in coil 1402 and coil 1414, via the magnetic field generated by a conductor of a cable (or conductors, if each energy harvesting device is coupled with different conductors) and captured by core 1403 and core 1415, respectively, may be actively rectified by the rectifier (i.e., the IGBTs 1434-1440 and capacitor 1412) to supply regulated voltages to one or more downhole devices (not pictured). A controller 1442 may be electronically coupled with the circuit 1400. The controller 1442 may be a DC controller configured to control the rectification by the IGBTs 1434-1440.

FIG. 14B includes a circuit 1401 of multiple energy harvesting devices supplying power to a load (i.e., a downhole device such as one or more sensors, valves, etc.). Circuit 1401 may be similar to circuit 1200 described in reference to FIG. 12A. However, the circuit 1400 is configured with insulated-gate bipolar transistors (IGBTs) and/or metal-oxide-semiconductor field-effect transistors (MOSFETs) rather than diodes. For example, the circuit 1200 may include a rectifier comprising IGBTs 1434, 1436, 1438, and 1440. Additionally, the circuit 1401 may include a capacitor 1412. A first energy harvesting device comprising a core 1403 and a coil 1402 may be electronically coupled with the components of circuit 1400 (e.g., the IGBTs 1434-1440 and capacitor 1412). Additionally, a second energy harvesting device comprising a core 1415 and a coil 1414 may be electronically coupled with the circuit 1401. FIG. 14B depicts the energy harvesting devices being electronically coupled in series. In some implementations, the energy harvesting devices may be in parallel. One or more downhole devices, represented by load 1416, may be electronically coupled with the components of the circuit 1401. The EMF generated in coil 1402 and coil 1414, via the magnetic field generated by a conductor of a cable (or conductors, if each energy harvesting device is coupled with different conductors) and captured by core 1403 and core 1415, respectively, may be actively rectified by the rectifier (i.e., the IGBTs 1434-1440 and capacitor 1412) to supply power to the load 1416. A controller 1442 may be electronically coupled with the circuit 1401. The controller 1442 may be a DC controller configured to control the rectification by the IGBTs 1434-1440.

Figure 15:
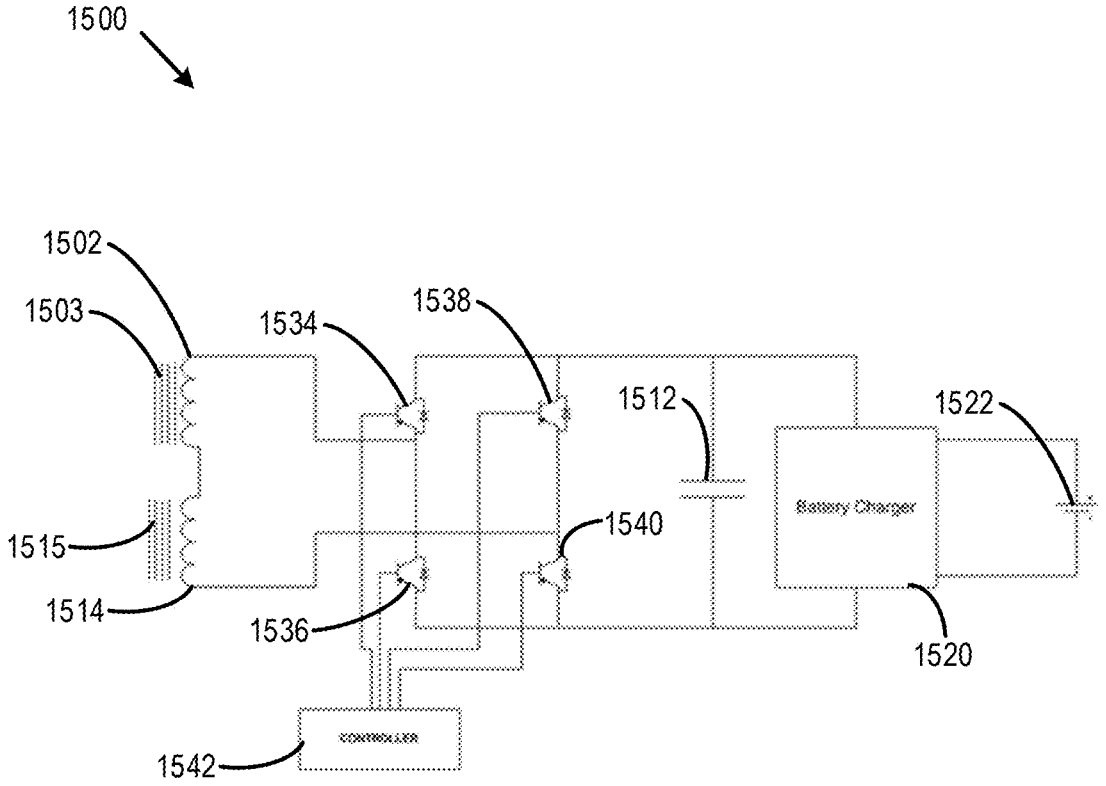
FIG. 15 is a schematic view of an example circuit to use with energy harvesting devices, according to some implementations.

FIG. 15 is a schematic view of an example circuit to use with energy harvesting devices, according to some implementations. FIG. 15 depicts a circuit 1500. The circuit may be similar to the circuit 1201 described in reference to FIG. 12B. However, the circuit 1500 is configured with insulated-gate bipolar transistors (IGBTs) and/or metal-oxide-semiconductor field-effect transistors (MOSFETs) rather than diodes. For example, circuit 1500 may include a rectifier comprising IGBTs 1534, 1536, 1538, and 1540. Additionally, the circuit 1500 may include a capacitor 1512. A first energy harvesting device comprising a core 1503 and a coil 1502 may be electronically coupled with the components of circuit 1500 (e.g., the switches 1534-1540 and capacitor 1512). Additionally, a second energy harvesting device comprising a core 1515 and a coil 1514 may be electronically coupled with the circuit 1500. FIG. 15 depicts the energy harvesting devices being electronically coupled in series. In some implementations, the energy harvesting devices may be in parallel. A battery charger 1520 and battery 1522 may be electronically coupled with the components of the circuit 1500. The EMF generated in coil 1502 and coil 1514, via the magnetic field generated by a conductor of a cable (or conductors, if each energy harvesting device is coupled with different conductors) and captured by core 1503 and core 1515, respectively, may be actively rectified by the rectifier (i.e., diodes 1534-1540 and capacitor 1512) to the battery charger 1520 configured to charge the battery 1522. A controller 1542 may be electronically coupled with the circuit 1500. The controller 1542 may be a DC controller configured to control the rectification by the IGBTs 1534-1540.

Figure 16:
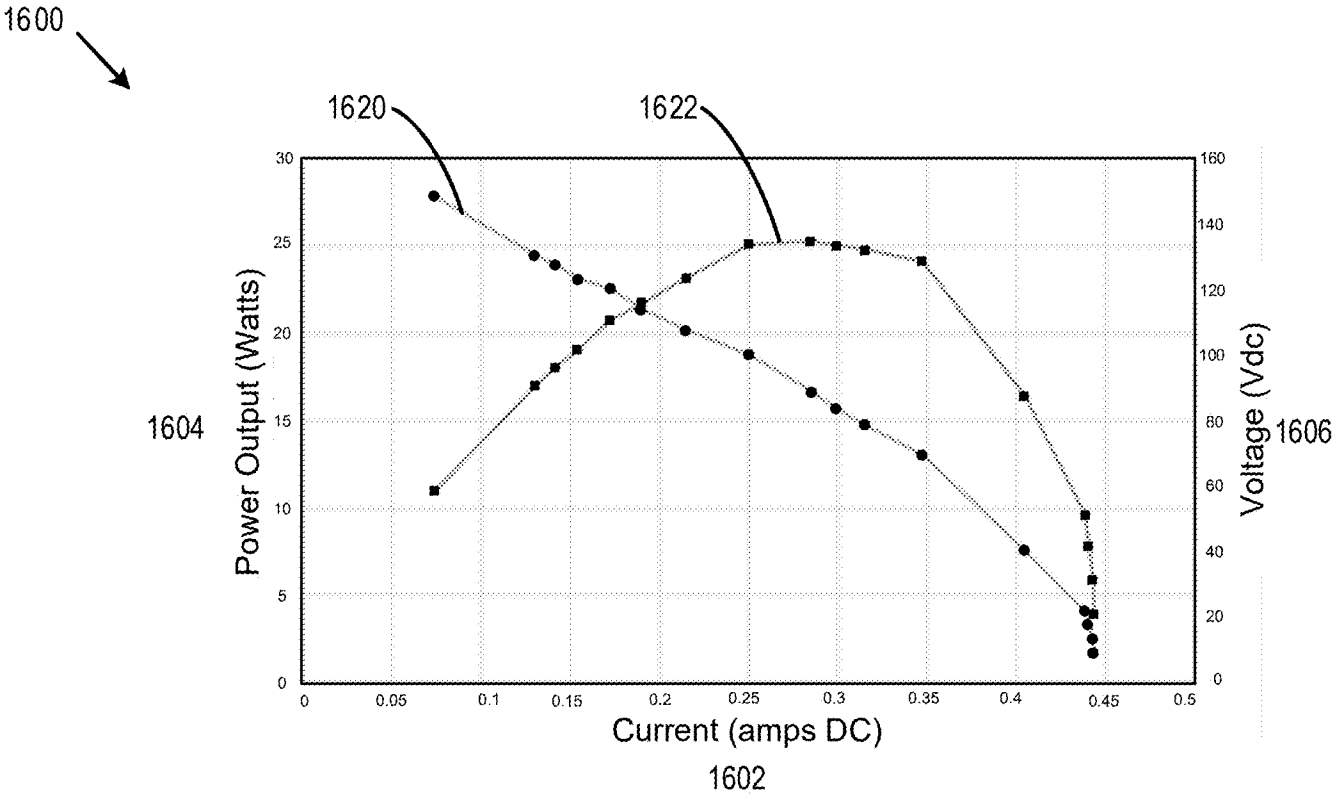
FIG. 16 is a graph of an example of power extracted from a cable by an energy harvesting device, according to some implementations.

FIG. 16 is a graph of an example of power extracted from a cable by an energy harvesting device, according to some implementations. In particular, FIG. 16 includes a chart 1600 with an x-axis 1602, a first y-axis 1604, and a second y-axis 1606. The x-axis 1602 is the current having units in direct current amperes (amps DC). The first y-axis 1604 is the power output having units in Watts (W). The second y-axis 1606 is the voltage having units in direct current volts (Vdc). Chart 1600 is an example in which a cable positioned in a wellbore is being supplied with 65 amperes (Amps) and 120 Hertz (Hz). In the example implementation, two energy harvesting devices approximately 1 m long are coupled with said cable, are electrically coupled in series, and are rectified. As the load (current) increases, the voltage (second y-axis 1606) decreases, as represented by the voltage curve 1620. The power curve 1622 depicts the power supplied by the energy harvesting devices with respect to current. As shown, stable operations (i.e., power will increase (power curve 1622 slope is positive) as current increases) may be performed with a current at approximately, or less than 0.25 amps DC to supply an optimum power of approximately 25 W (or less). For example, when operating at a current less than 0.25 amps DC, power will increase if any transient load and/or additional load is added to the system. If operating at a current greater than approximately 0.25 amps DC, power may decrease if any transient load and/or additional load is added to the system. Thus, the energy harvesting systems depicted in this example scenario may supply up to 25 W of power to one or more downhole devices.

Example Operations

Example operations for supplying power to one or more downhole devices via one or more energy harvesting devices are now described in reference to FIGS. 1-15.

Figure 17:
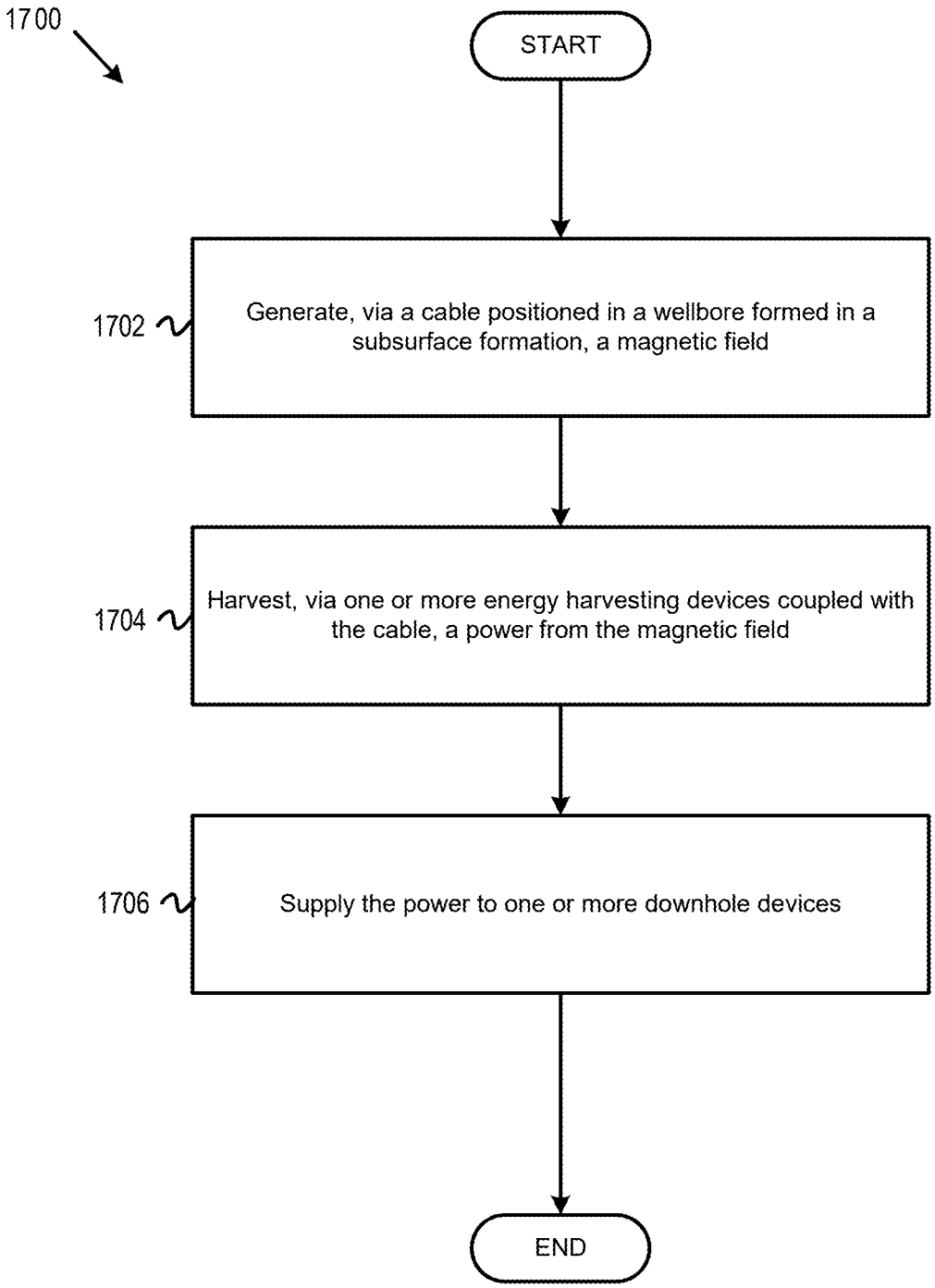
FIG. 17 is a flowchart of example operations for supplying power to one or more downhole devices via one or more energy harvesting devices, according to some implementations.

FIG. 17 is a flowchart of example operations for supplying power to one or more downhole devices via one or more energy harvesting devices, according to some implementations. FIG. 17 depicts a flowchart 1700 of operations to capture a magnetic field of a cable, generate a power from the captured magnetic field with one or more energy harvesting devices, and supply the power to one or more downhole devices. The operations of flowchart 1700 are described in reference to the ESP cable 140 of FIG. 1, the energy harvesting devices described in reference to FIGS. 3-10, and the circuits described in reference to FIGS. 11A-15.

At block 1702, a magnetic field may be generated via a cable positioned in a wellbore formed in a subsurface formation. The cable may be representative of the ESP cable 140 of FIG. 1. The cable may supply power from the surface to one or more devices downhole, such as an ESP. When current is flowing through the conductors of the cable, a magnetic field may surround the respective conductors.

At block 1704, a power may be harvested from the magnetic field, via one or more energy harvesting devices. The energy harvesting devices may be similar to the energy harvesting devices described in reference to FIGS. 3-10. For example, each energy harvesting device may be coupled to the cable and at least partially surround a conductor within the cable. In some implementations each energy harvesting device may be external to cable and/or integrated into the cable. Each energy harvesting device may include a core and a coil. The core may be configured to capture the magnetic field generated by the conductor the core surrounds. The coil may be wound around a portion of the core. The captured magnetic field in the core may induce an EMF in the coil.

At block 1706, the power may be supplied to one or more downhole devices. For example, the EMF in the coil may be actively rectified and utilized to supply voltages to one or more downhole devices. The downhole devices may include sensors, valves, inflow control devices, batteries, or any other suitable device that may require power to function. In some implementations, multiple energy harvesting devices may be electrically coupled in series or in parallel to meet the power requirements of the associated downhole device.

While the aspects of the disclosure are described with reference to various implementations and exploitations, it will be understood that these aspects are illustrative and that the scope of the claims is not limited to them. In general, techniques for generating power from a magnetic field from a cable, via one or more energy harvesting devices, to be supplied to one or more downhole devices as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may generally be integrated together in a single software product or packaged into multiple software products. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subsurface formation" shall be construed as encompassing both areas below exposed earth and areas below earth covered by water such as ocean or fresh water.

EXAMPLE IMPLEMENTATIONS

Implementation #1: A system comprising: a power cable to be positioned downhole in a wellbore formed in a subsurface formation, wherein the power cable generates a magnetic field; and a first energy harvesting device coupled with the power cable and configured to harvest power from the magnetic field, wherein the power is to be supplied to one or more downhole devices.

Implementation #2: The system of Implementation #1, further comprising: a core at least partially surrounding the power cable and configured to capture the magnetic field generated by the power cable; and a coil wound around the core, where an electromotive force is induced in the coil by the magnetic field captured by the core.

Implementation #3: The system of Implementation #2, further comprising a rectifier configured to rectify the electromotive force prior to the power being supplied to the one or more downhole devices.

Implementation #4: The system of Implementation #2 or 3, wherein the core is configured with at least one of ferrites, stacked laminations, or sintered soft magnetic composites.

Implementation #5: The system of any one or more of Implementations #1-4, wherein the power cable is configured to supply power to a motor of an electric submersible pump, and wherein the power cable includes one or more conductors.

Implementation #6: The system of Implementation #5, wherein the first energy harvesting device is coupled with a first conductor of the power cable, and wherein the system comprises a second energy harvesting device is coupled with a second conductor of the power cable and a third energy harvesting device coupled with a third conductor of the power cable.

Implementation #7: The system of any one or more of Implementations #1-6, wherein the one or more downhole devices includes at least one of one or more sensors, one or more batteries, one or more inflow control devices, one or more actuators, or one or more valves.

Implementation #8: The system of any one or more of Implementations #1-7, further comprising: a second energy harvesting device configured to be electrically coupled to the first energy harvesting device, wherein the first energy harvesting device is in series or in parallel with the second energy harvesting device, and wherein an electromotive force of the first energy harvesting device and the second energy harvesting device are put in series or in parallel before or after rectification.

Implementation #9: The system of any one or more of Implementations #1-8, wherein the first energy harvesting device is without a rotating component, and wherein there is no direct electrical connection between the first energy harvesting device and the power cable.

Implementation #10: A method comprising: generating, via a power cable positioned downhole in a wellbore formed in a subsurface formation, a magnetic field; capturing power from the magnetic field; harvesting, via a first energy harvesting device coupled with the power cable, the power from the magnetic field; and supplying the power to one or more downhole devices.

Implementation #11: The method of Implementation #10, further comprising: capturing, via a core at least partially surrounding the power cable, the magnetic field generated by the power cable; and inducing, via a coil wound around the core, an electromotive force in the coil by the magnetic field captured by the core.

Implementation #12: The method of Implementation #11, further comprising: rectifying the electromotive force prior to the supplying of the power to the one or more downhole devices.

Implementation #13: The method of Implementation #11 or 12, wherein the core is configured with at least one of stacked laminations or sintered soft magnetic composites.

Implementation #14: The method of any one or more of Implementations #10-13, further comprising: supplying, via the power cable, power to a motor of to an electric submersible pump, and wherein the power cable includes one or more conductors.

Implementation #15: The method of Implementation #14, wherein the first energy harvesting device is coupled with a first conductor of the power cable and a second energy harvesting device is coupled with a second conductor of the power cable.

Implementation #16: The method of any one or more of Implementations #10-15, wherein the first energy harvesting device is electrically coupled to a second energy harvesting device, wherein the first energy harvesting device is in series or in parallel with the second energy harvesting device.

Implementation #17: An apparatus comprising: a first energy harvesting device coupled with a power cable positioned in a wellbore formed in a subsurface formation and configured to harvest power from a magnetic field generated by the power cable, wherein the power is to be supplied to one or more downhole devices.

Implementation #18: The apparatus of Implementation #17, further comprising: a core at least partially surrounding the power cable and configured to capture the magnetic field generated by the power cable; and a coil wound around the core, where an electromotive force is induced in the coil by the magnetic field captured by the core.

Implementation #19: The apparatus of Implementation #18, further comprising a rectifier configured to rectify the electromotive force prior to the power being supplied to the one or more downhole devices.

Implementation #20: The apparatus of any one or more of Implementations #17-19, further comprising a second energy harvesting device configured to be electrically coupled to the first energy harvesting device, wherein the first energy harvesting device is in series or in parallel with the second energy harvesting device.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A system comprising:

a power cable to be positioned downhole in a wellbore formed in a subsurface formation and configured to generate one or more magnetic fields;

a first energy harvesting device configured to partially, but not completely, surround a first conductor of the power cable and configured to harvest a power from a first magnetic field from the first conductor, wherein the power is to be supplied to one or more downhole devices; and a second energy harvesting device configured to partially, but not completely, surround a second conductor of the power cable and configured to harvest a power from a second magnetic field from the second conductor.

2. The system of claim 1, the first energy harvesting device further comprising:

a core configured to partially, but not completely, surround the first conductor of the power cable and configured to capture the first magnetic field generated by the first conductor; and a coil wound around the core, where an electromotive force is induced in the coil by the first magnetic field captured by the core.

3. The system of claim 2, further comprising a rectifier configured to rectify the electromotive force prior to the power being supplied to the one or more downhole devices.

4. The system of claim 2, wherein the core is configured with at least one of ferrites, stacked laminations, or sintered soft magnetic composites.

5. The system of claim 1, wherein the power cable is configured to supply power to a motor of an electric submersible pump, and wherein the power cable includes one or more conductors.

6. The system of claim 5 further comprising:

a third energy harvesting device partially, but not completely, surrounding a third conductor of the power cable.

7. The system of claim 1, wherein the one or more downhole devices includes at least one of one or more sensors, one or more batteries, one or more inflow control devices, one or more actuators, or one or more valves.

8. The system of claim 1 wherein the second energy harvesting device is configured to be electrically coupled to the first energy harvesting device, wherein the first energy harvesting device is in series or in parallel with the second energy harvesting device, and wherein an electromotive force of the first energy harvesting device and the second energy harvesting device are put in series or in parallel before or after rectification.

9. The system of claim 1, wherein the first energy harvesting device is without a rotating component, and wherein there is no direct electrical connection between the first energy harvesting device and the power cable.

10. A method comprising:

generating, via a power cable positioned downhole in a wellbore formed in a subsurface formation, one or more magnetic fields;

capturing power from the one or more magnetic fields;

harvesting, via a first energy harvesting device partially, but not completely, surrounding a first conductor of the power cable, a power from a first magnetic field from the first conductor;

harvesting, via a second energy harvesting device partially, but not completely, surrounding a second conductor of the power cable, a power from a second magnetic field from the second conductor; and supplying the power to one or more downhole devices.

11. The method of claim 10, further comprising:

capturing, via a core partially, but not completely, surrounding the first conductor of the power cable, the first magnetic field generated by the first conductor; and inducing, via a coil wound around the core, an electromotive force in the coil by the first magnetic field captured by the core.

12. The method of claim 11, further comprising:

rectifying the electromotive force prior to the supplying of the power to the one or more downhole devices.

13. The method of claim 11, wherein the core is configured with at least one of stacked laminations or sintered soft magnetic composites.

14. The method of claim 10, further comprising:

supplying, via the power cable, power to a motor of to an electric submersible pump, and wherein the power cable includes one or more conductors.

15. The method of claim 10, wherein the first energy harvesting device is electrically coupled to the second energy harvesting device, wherein the first energy harvesting device is in series or in parallel with the second energy harvesting device.

16. An apparatus comprising:

a first energy harvesting device configured to partially, but not completely, surround a first conductor of a power cable to be positioned in a wellbore formed in a subsurface formation and configured to harvest a power from a first magnetic field generated by the first conductor of the power cable, wherein the power is to be supplied to one or more downhole devices; and a second energy harvesting device configured to partially, but not completely, surround a second conductor of the power cable to be positioned in the wellbore and configured to harvest a power from a second magnetic field generated by the second conductor of the power cable.

17. The apparatus of claim 16, further comprising:

a core partially, but not completely, surrounding the first conductor of the power cable and configured to capture the first magnetic field generated by the first conductor; and a coil wound around the core, where an electromotive force is induced in the coil by the first magnetic field captured by the core.

18. The apparatus of claim 17, further comprising a rectifier configured to rectify the electromotive force prior to the power being supplied to the one or more downhole devices.

19. The apparatus of claim 16, wherein the second energy harvesting device is configured to be electrically coupled to the first energy harvesting device, wherein the first energy harvesting device is in series or in parallel with the second energy harvesting device.

* * * * *